US007742067B2

(12) United States Patent
Gomi et al.

(10) Patent No.: US 7,742,067 B2
(45) Date of Patent: Jun. 22, 2010

(54) IMAGE FORMING APPARATUS HAVING A EXPOSURE CONTROL UNIT CAPABLE OF CHANGING AN EXPOSURE RATIO BETWEEN A FIRST EXPOSURE RATIO AND A SECOND EXPOSURE RATIO DIFFERENT FROM THE FIRST EXPOSURE RATIO WHEN A FIRST EXPOSURE UNIT OR SECOND EXPOSURE UNIT EXPOSES AN IMAGE CARRIER ON THE BASIS OF IMAGE DATA FOR FORMING AN IMAGE WITH A CERTAIN DENSITY

(75) Inventors: Fumiteru Gomi, Abiko (JP); Ryuta Ai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 12/152,516

(22) Filed: May 14, 2008

(65) Prior Publication Data

US 2008/0292343 A1 Nov. 27, 2008

(30) Foreign Application Priority Data

May 14, 2007 (JP) ..... 2007-128638

(51) Int. Cl.
*B41J 2/47* (2006.01)

(52) U.S. Cl. ..... 347/240; 347/251

(58) Field of Classification Search ..... 347/131–133, 347/240, 251–254, 238
See application file for complete search history.

(56) References Cited

U.S. PATENT DOCUMENTS 5,955,237 A * 9/1999 Hattori et al. ..... 430/138
2008/0285991 A1* 11/2008 Oki ..... 399/51

FOREIGN PATENT DOCUMENTS

| | | | |
|---|---|---|---|
| JP | 63-173074 | A | 8/1988 |
| JP | 08-164634 | A | 6/1996 |
| JP | 9-169136 | A | 6/1997 |
| JP | 10-035008 | A | 2/1998 |
| JP | 11-326798 | A | 11/1999 |
| JP | 2003-023469 | A | 1/2002 |
| JP | 2002-062598 | A | 2/2002 |
| JP | 2002-166592 | A | 6/2002 |
| JP | 2002-264391 | A | 9/2002 |
| JP | 2003-285466 | A | 10/2003 |
| JP | 2003-323009 | A | 11/2003 |

* cited by examiner

*Primary Examiner*—Hai C Pham
(74) *Attorney, Agent, or Firm*—Canon U.S.A., Inc. I.P. Division

(57) ABSTRACT

In an early-middle stage of a photosensitive drum life cycle, an image forming apparatus uses only a second semiconductor laser having an oscillation wavelength 660 nm to perform writing of an electrostatic latent image on a photosensitive drum surface. In a middle-late stage of the photosensitive drum life cycle, the image forming apparatus starts using a first semiconductor laser having an oscillation wavelength of 440 nm in addition to the second semiconductor laser to perform writing of an electrostatic latent image on the photosensitive drum surface with a combined exposure spot formed at the same position. An exposure control unit gradually increases an output rate of the first semiconductor laser according to an increase in total output of the first and second semiconductor lasers.

9 Claims, 17 Drawing Sheets

IMAGE FORMING APPARATUS HAVING A EXPOSURE CONTROL UNIT CAPABLE OF CHANGING AN EXPOSURE RATIO BETWEEN A FIRST EXPOSURE RATIO AND A SECOND EXPOSURE RATIO DIFFERENT FROM THE FIRST EXPOSURE RATIO WHEN A FIRST EXPOSURE UNIT OR SECOND EXPOSURE UNIT EXPOSES AN IMAGE CARRIER ON THE BASIS OF IMAGE DATA FOR FORMING AN IMAGE WITH A CERTAIN DENSITY

BACKGROUND OF THE INVENTION

1. Field of the Invention

The present invention relates to an image forming apparatus that can perform multiple-exposure processing for forming an electrostatic latent image on an image carrier surface. More specifically, the present invention relates to an intensity control for exposure spots placed one upon another at the same exposure point.

2. Description of the Related Art

A conventional image forming apparatus can form an electrostatic latent image on a charged image carrier surface by performing scanning exposure using a plurality of laser beams and can develop a toner image with charged toner particles supplied onto the electrostatic latent image formed on the carrier surface. For example, a conventional apparatus can use a plurality of laser beams to form an image at the same position on an image carrier.

As discussed in Japanese Patent Application Laid-Open No. 11-326798, using semiconductor lasers differentiated in the size of optical spot is useful to smoothly reproduce a peripheral region of a latent image and form a combined toner image in a desired manner. As discussed in Japanese Patent Application Laid-Open No. 09-169136, a first beam having a beam diameter of 30 μm and a second beam having a beam diameter of 60 μm can be combined with each other while setting the ratio of 5:3 in the light quantity of light emission.

In general, the distribution of exposure amount at an exposure spot formed on an image carrier surface is a Gaussian distribution having a peak value at the center and peripheral values gradually decreasing as the distance from the center increases. Therefore, the electrostatic latent image of an exposure spot formed when electric charge is discharged with a current value corresponding to the exposure amount has an electric potential distribution (distribution of electrostatic charge amount) having a peak value at the center and peripheral values gradually approaching to a charging potential, which reflects the distribution of exposure amount.

The development of a toner image is dependent on a relationship between the potential distribution of an electrostatic latent image at the exposure spot and a development voltage set for a developing device. The potential distribution of an electrostatic latent image has an effect on the size or the density of a developed toner image (refer to FIGS. 9A and 9B). The size or the density of a toner image, even if the electrostatic latent image is the same, changes if any variation occurs in the development voltage or in the electrostatic charge amount of a developer.

More specifically, the size of a toner image if formed by developing an electrostatic latent image at the exposure spot is variable according to the potential distribution of an electrostatic latent image, the development voltage, or the electrostatic charge amount of a developer. If any change occurs in the size of a toner image resulting from the exposure spot, the line width of the toner image obtainable by scanning the exposure spot changes correspondingly. The density of an image formed by arraying development lines is also changed.

As described below, if the image carrier goes into a late stage of its life cycle, an electrostatic latent image having the same potential distribution cannot be reproduced even if the exposure is performed under the same conditions. The line width and the image density cannot be reproduced correctly for the same toner image.

Furthermore, depending on usage conditions of a developing device (e.g., deterioration in toner particles as a recording material) or if any change occurs in environmental conditions, the line width and the image density cannot be reproduced accurately for the same toner image to be produced from the same electrostatic latent image.

Furthermore, as discussed in Japanese Patent Application Laid-Open No. 2003-323009, the exposure of a pixel can be realized by a plurality of lasers. According to the configuration discussed in Japanese Patent Application Laid-Open No. 2003-323009, in order to accurately combine toner images, toner images formed by respective light beams are equalized. It is also required to equalize a combined toner image formed by placing light beams one upon another with each toner image formed by each light beam. Hence, to maintain the latent image potential at an appropriate level, the output power adjustment for each laser is performed every time the number of sheets reaches a predetermined value.

However, according to the configuration discussed in Japanese Patent Application Laid-Open No. 2003-323009, each laser has the same spot size and, if the laser power is adjusted to attain a target density level when the potential distribution changes due to deterioration, the line width of a latent image (potential distribution) changes correspondingly and the line width of a toner image is also changed. On the contrary, if the laser power is adjusted to maintain the same line width, the target density cannot be maintained.

SUMMARY OF THE INVENTION

Exemplary embodiments of the present invention are directed to an image forming apparatus capable of maintaining accurate reproducibility in line width and/or density of an image regardless of usage conditions of the image forming apparatus or even if any change occurs in environmental conditions.

According to an aspect of the present invention, an image forming apparatus includes an image carrier having a surface, a charging device configured to charge the surface of the image carrier, an exposure device configured to expose the surface of the image carrier to light after the surface of the image carrier is charged by the charging device, wherein the exposure device comprises a first exposure unit configured to perform exposure with a first laser and a second exposure unit configured to perform exposure with a second laser, and wherein the first laser has a first spot size, the second laser has a second spot size, and the second spot size is larger than the first spot size, an image formation unit configured to develop an electrostatic latent image formed by the exposure device into a toner image and form a developed toner image on a recording material, and an exposure control unit configured to select one of a first mode and a second mode when an electrostatic latent image is formed with exposure spots of the first laser and the second laser placed one upon another in forming a toner image, wherein an exposure ratio of the first laser to the second laser is set to a first value in the first mode and is set to a second value in the second mode, wherein the second value is different from the first value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain principles of the invention.

DETAILED DESCRIPTION OF THE EMBODIMENTS

The following description of exemplary embodiments is illustrative in nature and is in no way intended to limit the invention, its application, or uses. Processes, techniques, apparatus, and systems as known by one of ordinary skill in the art are intended to be part of the enabling description where appropriate. It is noted that throughout the specification and drawings, a reference mark refers to the same item or the same type of item where it occurs in more than one location, and thus, once an item is described with respect to one figure, it may not be discussed for other figures where such discussion would be redundant. Exemplary embodiments of the present invention are described in detail below with reference to the drawings.

Exemplary embodiments of the present invention are directed to an image forming apparatus configured to form an electrostatic latent image on an image carrier surface by placing exposure spots one upon another which are differentiated in the size of their exposure area at the exposure point. A part or the whole of each exemplary embodiment can be executed in another exemplary embodiment that includes an alternative configuration. Two or more exposures can be simultaneously performed by placing exposure spots one upon another at the same time or can be sequentially performed by placing exposure spots one upon another with an appropriate delay time.

An exemplary embodiment of the present invention is, for example, an image forming apparatus that includes a single image carrier associated with developing devices of respective colors. According to another exemplary embodiment, an image forming apparatus includes image formation units of respective color toners disposed along or around an intermediate transfer member and a recording material conveyance member. According to another exemplary embodiment, an image forming apparatus includes an image carrier configured to directly transfer a monotone image to a recording material.

In the following description, an exemplary embodiment chiefly describes a mechanism for forming toner images which can be assembled with or incorporated into other constituent components (functional devices, equipments, and casing) of an image forming apparatus. The present invention can be applied to various image forming apparatuses, including printers, printing presses, copy machines, facsimile machines, and multifunction peripherals.

First Exemplary Embodiment

Figure 1:
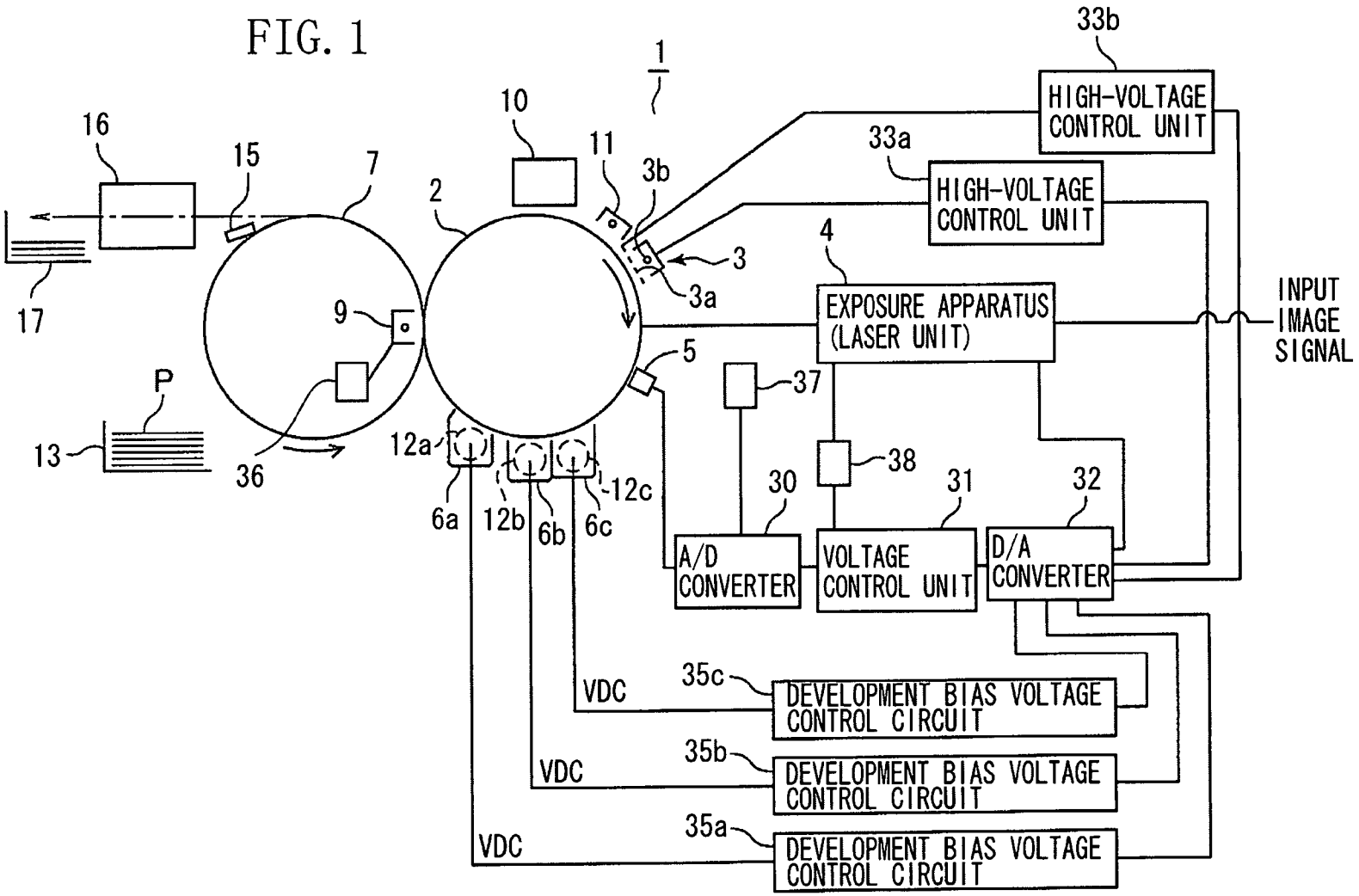
FIG. 1 illustrates an example of an image forming apparatus according to a first exemplary embodiment of the present invention.
Figure 2:
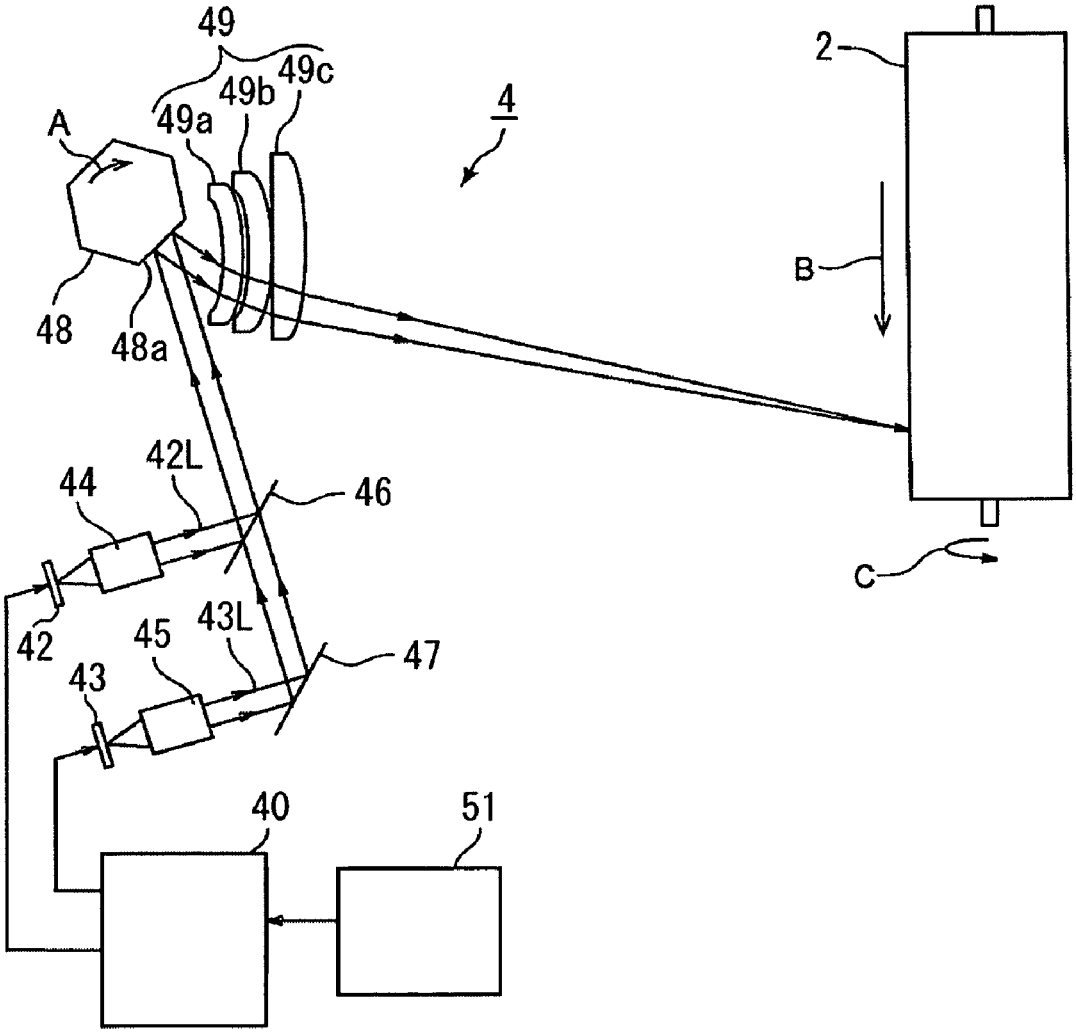
FIG. 2 illustrates an example of a configuration of an exposure device.

FIG. 1 illustrates an example of an image forming apparatus according to a first exemplary embodiment of the present invention. FIG. 2 illustrates an example of an exposure device. An image forming apparatus 1 is a full-color image forming apparatus configured to sequentially transfer magenta, cyan, and yellow toner images from a photosensitive drum 2 to a recording material P held on a transfer drum 7 to form a combined color image by placing magenta, cyan, and yellow toner images one upon another.

As illustrated in FIG. 1, the image forming apparatus 1 includes the photosensitive drum 2 (an example photosensitive member) that can rotate in the sub scanning direction indicated by an arrow when driven by a driving mechanism (not illustrated). A primary charging device 3, an exposure device 4, a surface potential sensor 5, developing devices 6*a*, 6*b*, and 6*c*, the transfer drum 7, a transfer charging device 9, a cleaning device 10, and a static eliminator 11 are disposed around the photosensitive drum 2.

The primary charging device 3 can uniformly charge a surface of photosensitive drum 2 prior to laser beam scanning exposure performed by the exposure device 4. The primary charging device 3 includes a grid electrode 3*a* which receives a grid bias voltage VG from a high-voltage control unit 33*a*.

Furthermore, the primary charging device 3 includes a corona wire 3*b* that can generate a corona discharge when a corona wire voltage is applied from a high-voltage control unit 33*b*. The surface of photosensitive drum 2 is irradiated with charged particles by an amount corresponding to the grid bias voltage VG.

The exposure device 4 can form an electrostatic latent image on the surface of photosensitive drum 2 by performing main scanning with a laser beam modulated according to an image signal.

Referring now also to FIG. 2, a half mirror 46 reflects a laser beam 42L. A laser beam 43L reflected by a reflection mirror 47 passes the half mirror 46. Both the laser beam 42L and the laser beam 43L travel on the same optical path and reach an optical deflector 48. A semiconductor laser 42 emits the laser beam 42L. A collimator lens 44 converts the laser beam 42L into a parallel beam. A semiconductor laser 43 emits the laser beam 43L. A collimator lens 45 converts the laser beam 43L into a parallel beam.

The optical deflector 48 is a rotary polygonal mirror which has a plurality of reflection surfaces and can rotate in the direction indicated by an arrow A at a predetermined speed when driven by a motor (not illustrated). The optical deflector 48 causes an exposure spot of the laser beam 42L and an exposure spot of the laser beam 43L to scan in the main scanning direction B on the surface of photosensitive drum 2 that rotates in the sub scanning direction C.

An image forming optical unit 49 includes three lenses 49*a*, 49*b*, and 49*c* combined in a predetermined positional relationship to realize required f-θ characteristics. The image forming optical unit 49 can form an image of the parallel laser beams 42L and 43L on the surface of photosensitive drum 2 and can form duplex exposure spots on the same exposure point.

An exposure control unit 51 controls a light emission signal generator 40 based on image data of respective colors of an image to be formed and later-described various conditional data. The light emission signal generator 40 drives the semiconductor laser 42 having an oscillation wavelength of 660 nm and the semiconductor laser 43 having an oscillation wavelength of 440 nm based on the same image signal and the same intensity rate supplied from the exposure control unit 51.

Thus, two laser beams 42L and 43L simultaneously scan the surface of photosensitive drum 2 and spatially place the exposure spots of the laser beam 43L and the laser beam 42L one upon another.

As illustrated in FIG. 1, the developing devices 6*a*, 6*b*, and 6*c* filled with color toners of magenta, cyan, and yellow can supply respective color toners onto the surface of photosensitive drum 2 to develop the electrostatic latent image into corresponding toner images according to the development voltage VDC. Each of developing sleeves 12*a*, 12*b*, and 12*c* can hold a thin layer of color toners and can rotate while maintaining a small clearance between the sleeve body and the surface of photosensitive drum 2. The developing sleeves 12*a*, 12*b*, and 12*c* are associated with development bias voltage control circuits 35*a*, 35*b*, and 35*c* and, if the development voltage VDC is applied from these circuits, cause toner particles to move under the electrostatic force toward the electrostatic latent image on the surface of photosensitive drum 2.

The transfer drum 7 holds the recording material P fed from a sheet cassette 13 and rotates to cause the recording material P to contact the toner image on the surface of photosensitive drum 2. The transfer charging device 9, if a transfer voltage is applied from a transfer voltage control circuit 36, charges the recording material P to have the polarity opposed to the toner image and causes the toner image to move from the photosensitive drum 2 to the recording material P.

The cleaning device 10 removes toner particles from the surface of photosensitive drum 2 if the toner particles remain on the drum 2 without being transferred onto the recording material P. The static eliminator 11 removes electric charges from the surface of photosensitive drum 2 to erase the electrostatic latent image. This is preparation for the next toner image formation.

In the first rotation of the photosensitive drum 2, the exposure device 4 writes image information for a magenta image (forms an electrostatic latent image of magenta) on the surface of photosensitive drum 2. The developing device 6*a* develops the electrostatic latent image with magenta toner. The magenta toner image thus formed is transferred onto the recording material P held by the transfer drum 7. In the second rotation of the photosensitive drum 2, the exposure device 4 writes image information for a cyan image (forms an electrostatic latent image of cyan) on the surface of photosensitive drum 2. The developing device 6*a* develops the electrostatic latent image with cyan toner. The cyan toner image thus formed is transferred onto the recording material P. In the third rotation of the photosensitive drum 2, the exposure device 4 writes image information for a yellow image (forms an electrostatic latent image of yellow) on the surface of photosensitive drum 2. The developing device 6*a* develops the electrostatic latent image with yellow toner. The yellow toner image thus formed is transferred onto the recording material P.

Then, the recording material P on which the color toner images of magenta, cyan, and yellow are sequentially transferred is separated from the surface of transfer drum 7 by a separating member 15 that abuts the transfer drum 7 and is conveyed to a fixing device 16. The fixing device 16 applies a heating/pressing treatment on the recording material P to fix the color toner images transferred on the surface of recording material P. The recording material P on which a full-color image is formed is then discharged to a discharge tray 17.

Figure 3A:
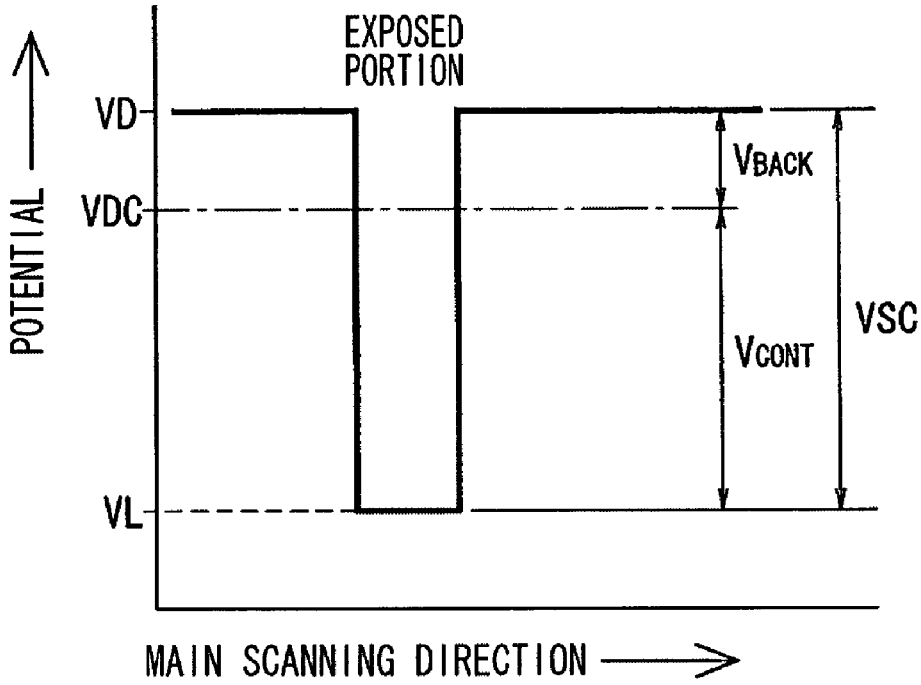
FIGS. 3A and 3B illustrate examples of development contrast.
Figure 3B:
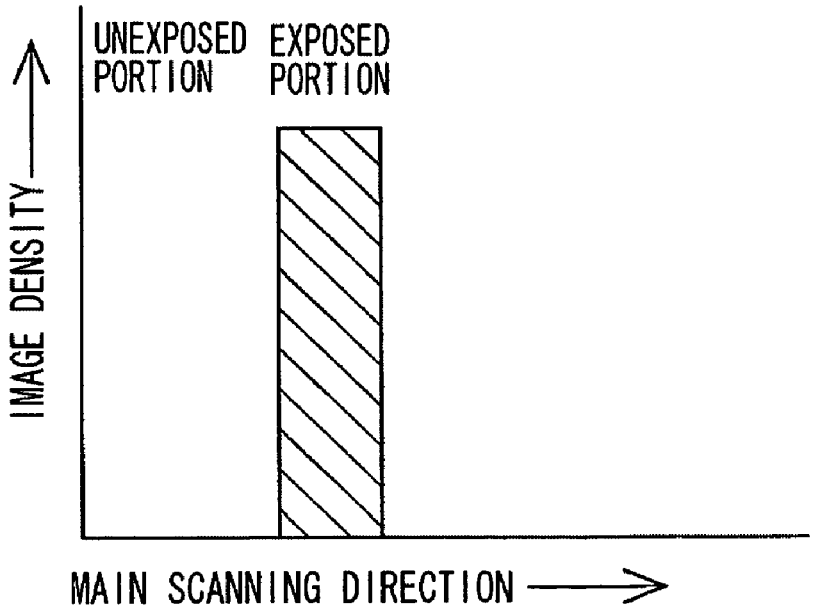
Figure 4:
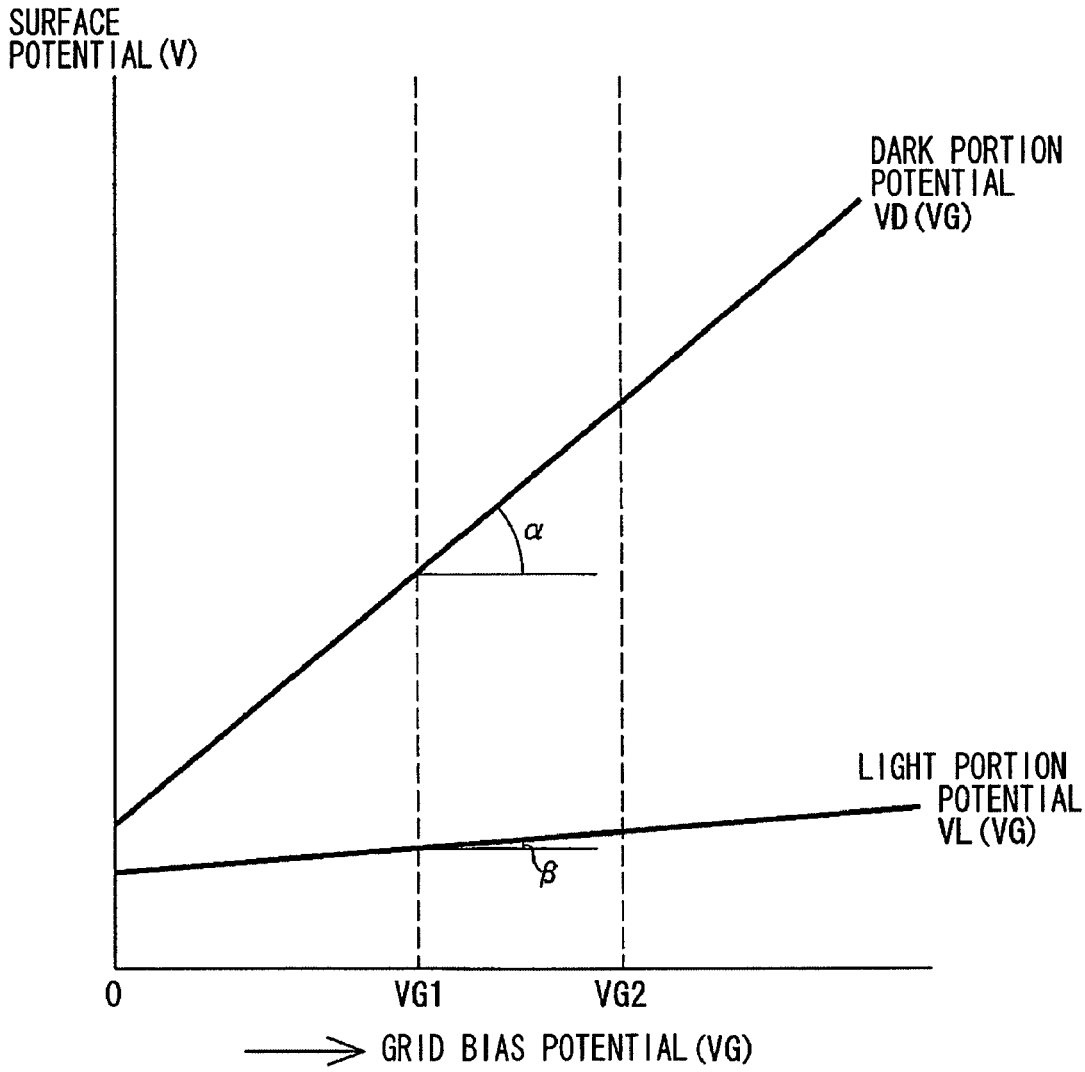
FIG. 4 illustrates an example of measurement results with respect to surface potential of a photosensitive drum.

Reference is now made also to FIGS. 3A, 3B, and 4. FIGS. 3A and 3B illustrate examples development contrast. FIG. 4 illustrates an example of measurement results with respect to the surface potential of a photosensitive drum. FIG. 3A illustrates the surface potential distribution of an electrostatic latent image in the main scanning direction. FIG. 3B illustrates the density distribution of a toner image, which can be obtained by developing the electrostatic latent image, in the main scanning direction.

A reversal developing system employed in the first exemplary embodiment causes toner particles to adhere on an exposed portion of the photosensitive drum 2. As illustrated in FIG. 3A and referring back to FIG. 1, the primary charging device 3 uniformly charges the surface of photosensitive drum 2 to have a dark portion potential VD of the negative polarity. The exposure device 4 exposes the photosensitive drum 2 to the writing light that forms an electrostatic latent image having light portion potential VL. Then, the development voltage VDC is applied to the developing sleeves 12*a*, 12*b*, and 12*c* to develop the electrostatic latent image into toner images in a state where charged toner particles with the negative polarity are layered on respective developing sleeves 12*a*, 12*b*, and 12*c*. The development voltage VDC has an electric potential between the dark portion potential VD and the light portion potential VL.

The light portion potential VL is a negative potential close to the ground potential. The ground potential in this embodiment is at zero volts. The toner particles with the negative polarity are attracted to the electrostatic latent image of light portion potential VL which is on the positive side of the development voltage VDC. The amount of toner particles attracted under an electrostatic force is proportional to development contrast $V_{CONT}$ that represents a difference between the light portion potential VL and the development voltage VDC. Thus, the toner image can be developed as illustrated in FIG. 3B.

Accordingly, the development contrast $V_{CONT}$ produces an electrostatic attraction force applied to charged toner particles which are supplied from the developing sleeves 12*a*, 12*b*, and 12*c* to the exposed portion of the photosensitive drum 2. In this example, fog removal voltage $V_{BACK}$ represents a difference between the dark portion potential VD and the development voltage VDC. The fog removal voltage $V_{BACK}$ is set to be a predetermined voltage value to eliminate any adhesion (fogging) of the toner particles with the negative polarity on an unexposed portion. The latent image contrast voltage VSC is equal to a sum of the development contrast $V_{CONT}$ and the fog removal voltage $V_{BACK}$.

However, if the ambient humidity of the photosensitive drum 2 increases, the amount of toner particles adhering to an electrostatic latent image increases and the density of a toner image increases. If the ambient humidity decreases, the amount of toner particles adhering to an electrostatic latent image decreases and the density of a toner image decreases. If the same electrostatic latent image is developed by the developing devices 6*a*, 6*b*, and 6*c*, developed toner images are different in density.

Hence, a voltage control unit 31 obtains absolute humidity hum_abs from an output of a temperature/humidity sensor 37 and determines target development contrast $V_{CONT}$ for each combination of the absolute humidity range and respective developing devices 6*a*, 6*b*, and 6*c*, as described on table 1. The temperature/humidity sensor 37 measures the ambient temperature and the humidity of the photosensitive drum 2 and outputs an analog voltage signal representing the absolute humidity. An analog/digital (A/D) converter 30 receives an analog voltage signal from the temperature/humidity sensor 37 and converts the received analog voltage signal into a digital signal. The voltage control unit 31 receives the digital signal output from the A/D converter 30.

TABLE I

DEVELOPMENT CONTRAST REQUIRED FOR EACH COLOR AND EACH ENVIRONMENT

| ENVIRONMENT | ABSOLUTE HUMIDITY hum_abs (g) | Vcont (V) Y | M | C |
|---|---|---|---|---|
| 1 | hum_abs ≦ 1.2 | 280 | 250 | 250 |
| 2 | 1.2 < hum_abs ≦ 1.56 | 276.2 | 246.4 | 246.4 |
| 3 | 1.56 < hum_abs ≦ 1.94 | 272.4 | 242.8 | 242.8 |
| 4 | 1.94 < hum_abs ≦ 2.33 | 268.6 | 239.2 | 239.2 |
| 5 | 2.33 < hum_abs ≦ 2.72 | 264.3 | 235.6 | 235.6 |
| 6 | 2.72 < hum_abs ≦ 3.13 | 261 | 232 | 232 |
| 7 | 3.13 < hum_abs ≦ 3.54 | 257.2 | 228.4 | 228.4 |
| 8 | 3.54 < hum_abs ≦ 3.97 | 253.4 | 224.8 | 224.8 |
| 9 | 3.97 < hum_abs ≦ 4.42 | 249.6 | 221.2 | 221.2 |
| 10 | 4.42 < hum_abs ≦ 4.88 | 245.3 | 217.6 | 217.6 |
| 11 | 4.88 < hum_abs ≦ 5.37 | 242 | 214 | 214 |
| 12 | 5.37 < hum_abs ≦ 5.87 | 233.2 | 210.4 | 210.4 |
| 13 | 5.87 < hum_abs ≦ 6.39 | 234.4 | 206.8 | 206.8 |
| 14 | 6.39 < hum_abs ≦ 6.94 | 230.6 | 203.2 | 203.2 |
| 15 | 6.94 < hum_abs ≦ 7.51 | 226.3 | 199.6 | 199.6 |
| 16 | 7.51 < hum_abs ≦ 8.12 | 223 | 196 | 196 |
| 17 | 8.12 < hum_abs ≦ 8.74 | 219.2 | 192.4 | 192.4 |
| 18 | 8.74 < hum_abs ≦ 9.4 | 215.4 | 188.8 | 188.8 |
| 19 | 9.4 < hum_abs ≦ 10.09 | 211.6 | 185.2 | 185.2 |
| 20 | 10.09 < hum_abs ≦ 10.82 | 207.8 | 181.6 | 181.6 |

TABLE I-continued

DEVELOPMENT CONTRAST REQUIRED FOR EACH COLOR AND EACH ENVIRONMENT

| ENVIRONMENT | ABSOLUTE HUMIDITY hum_abs (g) | Vcont (V) Y | M | C |
|---|---|---|---|---|
| 21 | 10.82 < hum_abs ≦ 11.58 | 204 | 178 | 178 |
| 22 | 11.58 < hum_abs ≦ 12.38 | 200.2 | 174.4 | 174.4 |
| 23 | 12.38 < hum_abs ≦ 13.21 | 196.4 | 170.8 | 170.8 |
| 24 | 13.21 < hum_abs ≦ 14.09 | 192.6 | 167.2 | 167.2 |
| 25 | 14.09 < hum_abs ≦ 15 | 188.8 | 163.6 | 163.6 |
| 26 | 15 < hum_abs ≦ 15.96 | 185 | 160 | 160 |
| 27 | 15.96 < hum_abs ≦ 16.97 | 181.2 | 156.4 | 156.4 |
| 28 | 16.97 < hum_abs ≦ 18.02 | 177.4 | 152.8 | 152.8 |
| 29 | 18.02 < hum_abs ≦ 19.12 | 173.6 | 149.2 | 149.2 |
| 30 | 19.12 < hum_abs ≦ 20.27 | 169.8 | 145.6 | 145.6 |
| 31 | 20.27 < hum_abs ≦ 21.6 | 166 | 142 | 142 |
| 32 | 21.6 < hum_abs | 162.2 | 138.4 | 138.4 |

The dark portion potential VD is required to be set in a potential region where no drum memory is generated. If the dark portion potential VD is set to be an excessively lower level, the occurrence of an image exposure ghost tends to increase. The image exposure ghost is dependent on a difference in the remaining amount of the carrier generated at an exposed portion and an unexposed portion on the photosensitive drum 2 during previous exposure. This reflects a potential difference generated on the surface of photosensitive drum 2 after the drum 2 has passed the charging device 3.

The image exposure ghost is sensitive to carrier traveling characteristics of a photosensitive material used for the photosensitive drum 2. The generation of an image exposure ghost is variable according to the ambient humidity of the photosensitive drum 2.

In general, the image exposure ghost does not appear if the potential contrast $\{(VD-VL)/(VD+VL)\}$ is small in both an exposed portion and an unexposed portion of the photosensitive drum 2. However, simply increasing the dark portion potential VD for enhancing the contrast is undesirable because the durability of the photosensitive drum 2 deteriorates if the dark portion potential VD is set to a higher level. Therefore, it is useful to set the dark portion potential VD to a sufficiently lower level so that generation of any image exposure ghost can be suppressed.

Hence, the voltage control unit 31 obtains absolute humidity hum_abs from an output of the temperature/humidity sensor 37 and obtains, with reference to table 2, a lower limit value for the charging potential that can suppress generation of any image exposure ghost, and sets a charging potential within a range not less than the lower limit value.

TABLE 2

| ENVIRONMENT | ABSOLUTE HUMIDITY hum_abs (g) | NUMBER OF IMAGE FORMATIONS 0~25k LOWER LIMIT | 25k~50k LOWER LIMIT | 50k~75k LOWER LIMIT | 75k~100k LOWER LIMIT |
|---|---|---|---|---|---|
| 1 | 0.86 | 675 | 705 | 735 | 765 |
| 2 | 1.73 | 650 | 680 | 710 | 740 |
| 3 | 5.8 | 625 | 655 | 685 | 715 |
| 4 | 8.9 | 600 | 630 | 660 | 690 |
| 5 | 15 | 575 | 605 | 635 | 665 |
| 6 | 18 | 550 | 580 | 610 | 640 |
| 7 | 21.6 | 525 | 555 | 585 | 615 |

As illustrated in FIG. 1, the image forming apparatus 1 includes a counter 38 that records a number of image formations (number of exposures, cumulative number of developing operations, and the like). The voltage control unit 31 sets lower-limit values of the charging potential which are differentiated according to the number of image formations detected by the counter 38, as illustrated in table 2.

In other words, the voltage control unit 31 determines the lower limit values of the charging potential considering the aging deterioration of a photosensitive material used for the photosensitive drum 2 (e.g., considering a variation in carrier traveling characteristics of the photosensitive material). The occurrence of an image exposure ghost varies if the carrier traveling characteristics of the photosensitive material change.

An upper-limit value of the charging potential is equivalent to a charging potential obtained when the grid high-voltage is equal to an upper-limit value of −900V (a maximum value that the primary charging device 3 can set). It is useful to set a charging potential setting range defined between upper and lower limit values as wide as possible. This is believed substantially to minimize the amount of processing in a later-described charging potential setting routine. This can improve the productivity of the image forming apparatus 1.

In general, the exposure sensitivity of the photosensitive drum 2 gradually deteriorates if the photosensitive drum 2 is used for a long term due to various reasons (deterioration in sensitivity characteristics caused by temperature changes in operational environmental conditions, or optical fatigue occurring in a photosensitive layer when exposure and charging processing is repetitively performed).

If the exposure sensitivity of the photosensitive drum 2 decreases, the latent image contrast voltage VSC cannot be sufficiently obtained even if the conditions for exposure processing remain the same and charge conditions for the photosensitive drum 2 remain the same. Accordingly, the development contrast $V_{CONT}$ becomes insufficient if the same amount of development voltage VDC is subtracted. The adhesion amount of toner particles decreases. The density of a toner image decreases.

Hence, the voltage control unit 31 evaluates the exposure sensitivity of the photosensitive drum 2 based on a measurement result of the surface potential sensor 5 during the previous rotation of the photosensitive drum 2 prior to the image formation processing. If the voltage control unit 31 determines that the exposure sensitivity is deteriorated, the voltage control unit 31 can secure the development contrast $V_{CONT}$ by enhancing the charge conditions for the primary charging device 3 so as to increase the dark portion potential VD. Then, if the dark portion potential VD reaches the upper-limit value of −900V as a result of the above-described control, the voltage control unit 31 can secure the development contrast $V_{CONT}$ by enhancing the exposure conditions for the exposure device 4 so as to decrease the light portion potential VL.

The surface potential sensor 5 outputs an analog voltage signal representing the surface potential of photosensitive drum 2. The A/D converter 30 receives an analog voltage signal from the surface potential sensor 5 and converts the received analog voltage signal into a digital signal. The voltage control unit 31 receives the digital signal from the A/D converter 30.

The voltage control unit 31 sets predetermined grid bias voltages VG1 and VG2 serving as the grid high-voltage for the primary charging device 3. The surface potential sensor 5 measures dark portion potentials VD(VG1) and VD(VG2) as well as light portion potentials VL(VG1) and VL(VG2). Then, as illustrated in FIG. 4, the voltage control unit 31 obtains a gradient α based on the dark portion potentials VD(VG1) and VD(VG2) according to the following formula (1) and obtains a gradient β based on the light portion potentials VL(VG1) and VL(VG2) according to the following formula (2).

$$\alpha=\{VD(VG1)-VD(VG2)\}/(VG2-VG1) \quad (1)$$

$$\beta=\{VL(VG1)-VL(VG2)\}/(VG2-VG1) \quad (2)$$

Furthermore, the voltage control unit 31 performs linear approximation to obtain potential change characteristics of the photosensitive drum 2 based on the obtained gradient values α and β, dark portion potentials VD(VG1) and VD(VG2), and light portion potentials VL(VG1) and VL(VG2).

The following formulas (3) and (4) express potential change characteristics resulting from the linear approximation.

$$VD(VG)=\alpha(VG-VG1)+VD(VG1) \quad (3)$$

$$VL(VG)=\beta(VG-VG1)+VL(VG1) \quad (4)$$

Then, the voltage control unit 31 obtains the grid bias voltage VG corresponding to a sum of a target fog removal voltage $V_{BACK}$ and the development contrast $V_{CONT}$ according to the above-described formulas (3) and (4). Furthermore, the voltage control unit 31 obtains a development bias voltage VDC at the grid bias voltage VG.

Furthermore, the following formulas (5) and (6) can be derived from the relationship illustrated in the FIG. 3A.

$$VD-VL=V_{BACK}+V_{CONT} \quad (5)$$

$$VDC=VL+V_{CONT} \quad (6)$$

Then, the relationship of the above-described formulas (3) and (4) derives the following formula.

$$VG=\{VD(VG)-VL(VG)-(VD(VG1)-VL(VG1))\}/(\alpha-\beta)+VG1$$

Furthermore, the following formula (7) can be derived from the above-described formula (5).

$$VG=\{V_{BACK}+V_{CONT}-(VD(VG1)-VL(VG1))\}/(\alpha-\beta)+VG1 \quad (7)$$

The grid bias voltage VG can be determined unequivocally because all of the values in the formula (7) are known values.

The light portion potential VL, the dark portion potential VD, and the development bias voltage VDC obtained from the above-described formulas (3), (4), and (6) are stored in an internal memory of the voltage control unit 31 according to switching of the target values of the potential difference $V_{BACK}$ and the potential difference $V_{CONT}$.

The above-described calculations are established when the charging and exposure characteristics of the photosensitive drum 2 relative to VG can be linearly approximated based on initially measured VD(VG1), VD(VG2), VL(VG1), and VL(VG2). However, the actual approximation is far from a straight line.

Accordingly, if the predetermined grid bias voltages VG1 and VG2 are largely different from a value of VG to be set, the dark portion potential VD corresponding to a calculated grid bias voltage VG may differ from an actual value of the dark portion potential VD. Hence, according to the first exemplary embodiment, the grid bias voltages VG1 and VG2 are set to VG1=400V and VG2=700V considering the charging potential setting range.

Figure 5:
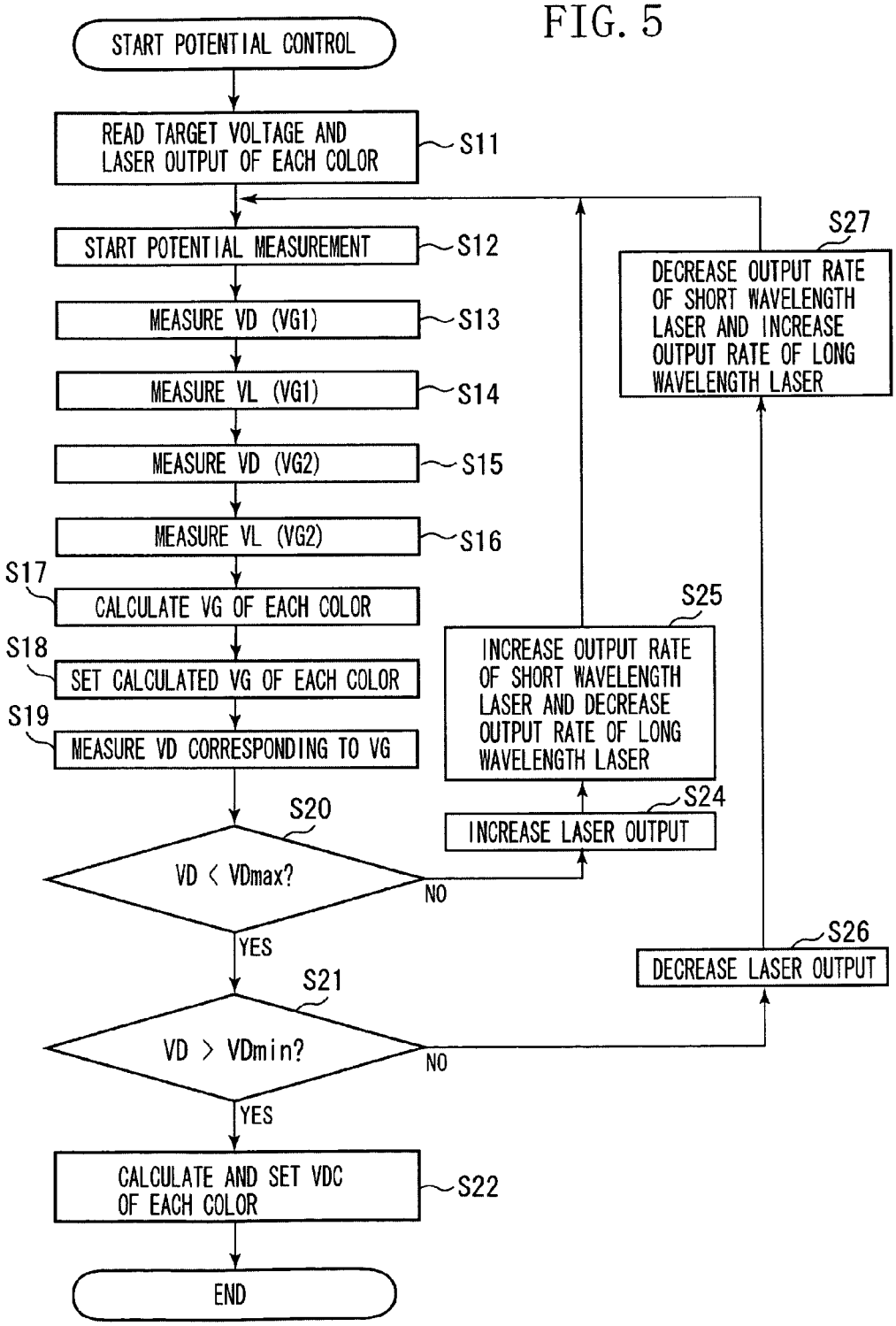
FIG. 5 is a flowchart illustrating an example of processing for controlling charging potential and an exposure output according to the first exemplary embodiment of the present invention.
Figure 6:
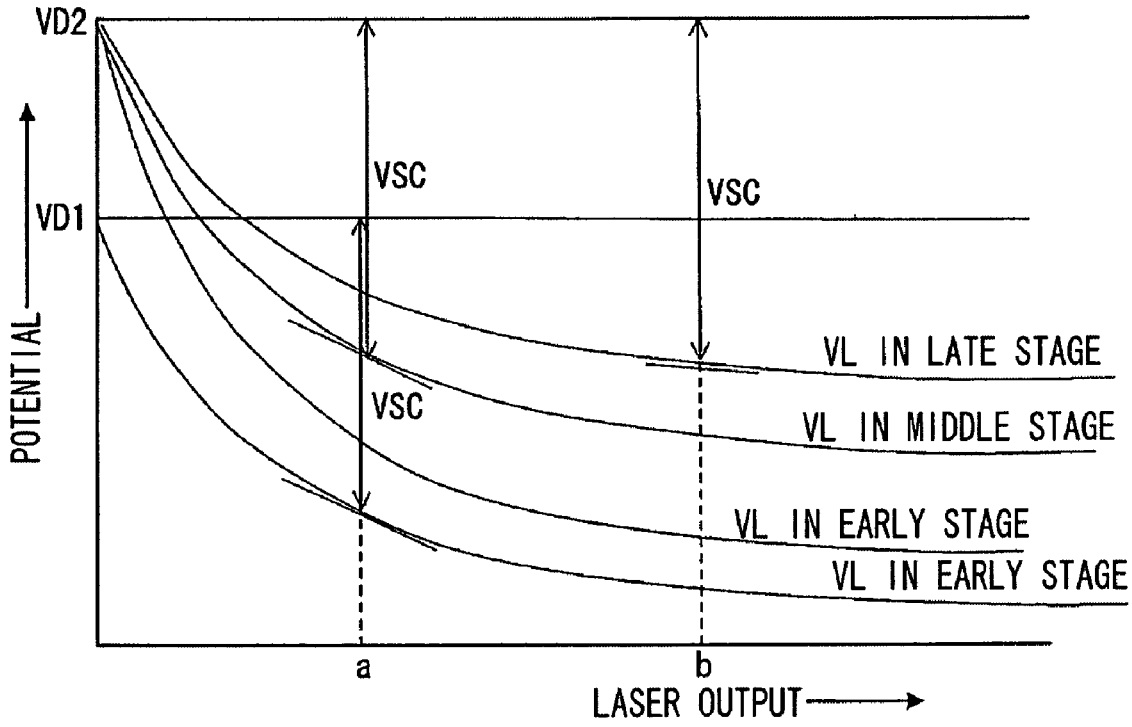
FIG. 6 is a graph illustrating an example of image density control according to deterioration in a sensitivity of a photosensitive drum.
Figure 7A:
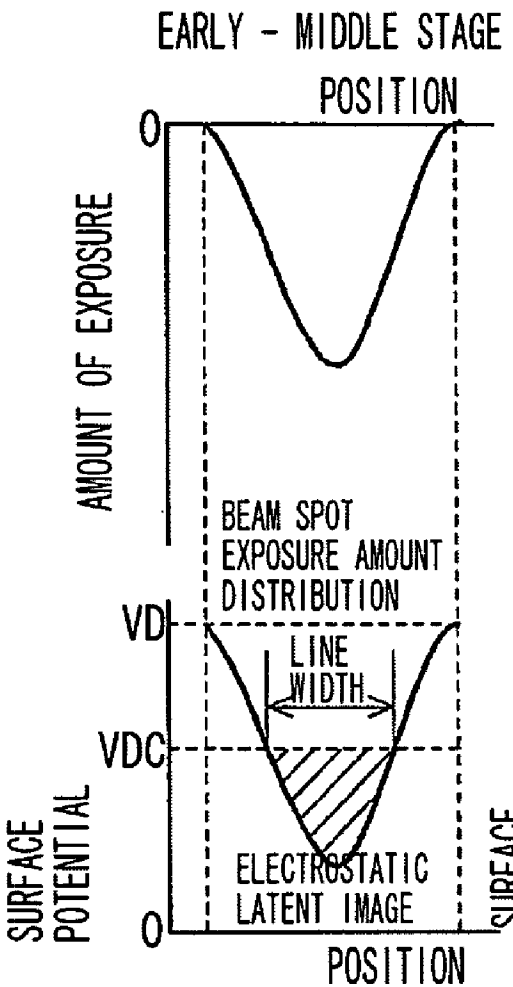
FIGS. 7A through 7C illustrate light quantity distribution of a combined exposure spot formed by multiple-exposure processing using a plurality of laser beams having different oscillation wavelengths and potential distribution of an electrostatic latent image.
Figure 7B:
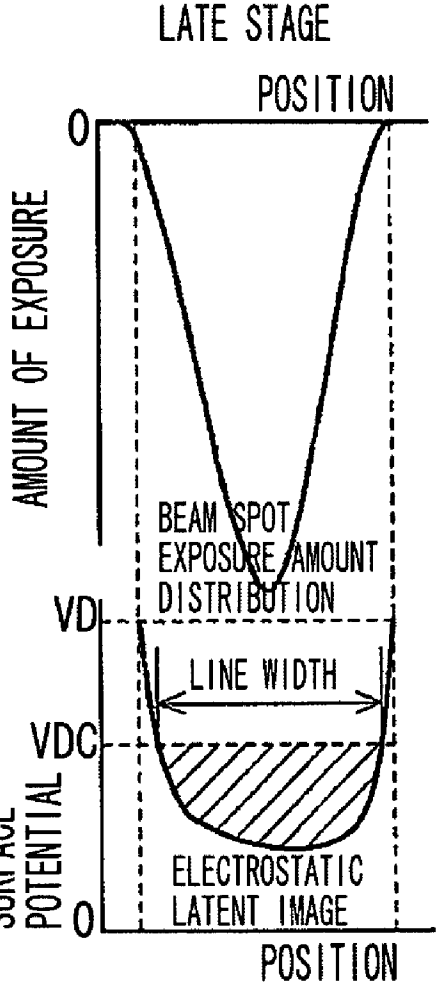
Figure 7C:
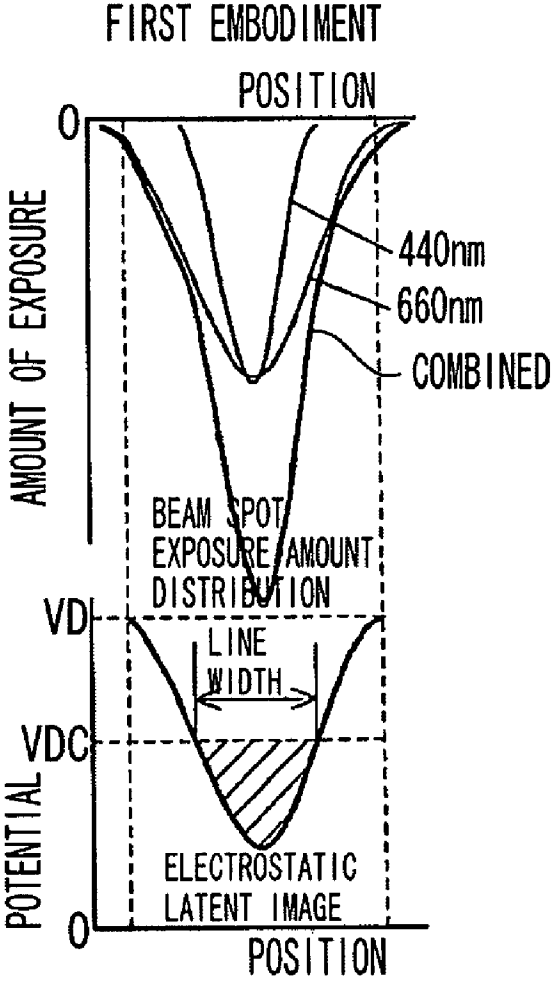

FIG. 5 is a flowchart illustrating an example of processing for controlling the charging potential and the exposure output according to the first exemplary embodiment. FIG. 6 is a graph illustrating an example of image density control according to deterioration in the sensitivity of a photosensitive drum. FIGS. 7A through 7C illustrate the potential distribution of an electrostatic latent image and the light quantity distribution of a combined exposure spot formed by multiple-exposure processing using a plurality of laser beams having different oscillation wavelengths, so that a predetermined density of toner image can be formed.

The exposure sensitivity of an organic photosensitive member of the photosensitive drum 2 deteriorates if the photosensitive drum 2 is used for a long term. Thus, in the early stage of the life cycle of the photosensitive drum 2, to secure a required development contrast $V_{CONT}$, the voltage control unit 31 gradually increases the charging potential while maintaining the exposure amount. However, if the charging potential reaches the upper-limit value of −900V, the voltage control unit 31 increases the laser output of the exposure device 4 by a predetermined amount. In this case, according to the first exemplary embodiment, the voltage control unit 31 changes an output ratio between two laser beams used for the multiple-exposure processing in such a manner that any change in the potential distribution of an electrostatic latent image formed on the combined exposure spot can be suppressed.

As illustrated in FIG. 5 and referring back to FIG. 1, the voltage control unit 31 executes an image density control prior to the image formation processing. First, the voltage control unit 31 causes the photosensitive drum 2 to start pre-rotation and, at the same time, causes the static eliminator 11 to remove electric charges remaining on the surface of photosensitive drum 2.

In step S11, the voltage control unit 31 obtains absolute humidity hum_abs from an output of the temperature/humidity sensor 37 and determines target values of the development contrast $V_{CONT}$ for four colors (refer to TABLE 1). Furthermore, the voltage control unit 31 determines the fog removal voltage $V_{BACK}$ and the laser output for four colors according to various image formation conditions (parameters).

In step S12, the voltage control unit 31 controls the primary charging device 3 and the exposure device 4 to let the surface potential sensor 5 start a potential measurement. First, the voltage control unit 31 applies a predetermined grid bias voltage VG1 to the grid electrode 3*a* of the primary charging device 3 to charge the photosensitive drum 2.

In step S13, the surface potential sensor 5 measures dark portion potential VD(VG1) which is not exposed by the exposure device 4. In step S14, the voltage control unit 31 causes the exposure device 4 to perform exposure processing. The surface potential sensor 5 measures light portion potential VL(VG1).

In step S15, the voltage control unit 31 applies another predetermined grid bias voltage VG2 to the grid electrode 3*a* of the primary charging device 3. The surface potential sensor 5 measures dark portion potential VD(VG2). In step S16, the voltage control unit 31 causes the exposure device 4 to perform exposure processing. The surface potential sensor 5 measures light portion potential VL(VG2).

In step S17, the voltage control unit 31 calculates grid bias voltage VG for the toner image formation of each color based on the measurement results according to the above-described formula (7).

In step S18, a digital/analog (D/A) converter 32 converts the grid bias voltage VG which is a digital signal obtained based on an output of the temperature/humidity sensor 37 into an analog signal. The D/A converter 32 sets (supplies) the converted analog signal to the high-voltage control unit 33*b*. Furthermore, the D/A converter 32 converts the corona wire voltage (a digital signal) into an analog signal and sets (supplies) the converted analog signal to the high-voltage control unit 33*a*.

In step S19, the voltage control unit 31 causes the surface potential sensor 5 to measure dark portion potential VD(VG) in a charged state corresponding to the grid bias voltage VG of each color. In step S20, the voltage control unit 31 determines whether the measured dark portion potential VD(VG) is smaller than an upper-limit value VDmax. If the voltage control unit 31 determines that the measured dark portion potential VD(VG) is equal to or greater than the upper-limit value VDmax (NO in step S20), the control flow proceeds to step S24. In step S24, the voltage control unit 31 causes the exposure control unit 51 (illustrated in FIG. 2) to increase the laser output.

More specifically, in step S25, the voltage control unit 31 decreases the output of the semiconductor laser 42 having the oscillation wavelength of 660 nm and increases the output of the semiconductor laser 43 having the oscillation wavelength of 440 nm. As described above, if the dark portion potential VD(VG) for a particular color is greater than the upper-limit value VDmax, the voltage control unit 31 increases the quantity of laser light used for the exposure of this color and executes similar processing to update the setting of grid bias voltage VG. After step S25, processing continues at step S12.

If the voltage control unit 31 determines that the measured dark portion potential VD(VG) is less than the upper-limit value VDmax (YES in step S20), the control flow proceeds to step S21. In step S21, the voltage control unit 31 determines whether the measured dark portion potential VD(VG) is greater than a lower-limit value VDmin. If the voltage control unit 31 determines that the measured dark portion potential VD(VG) is equal to or less than the lower-limit value VDmin (NO in step S21), the control flow proceeds to step S26.

In step S26, the voltage control unit 31 causes the exposure control unit 51 to decrease the laser output. In this case, the voltage control unit 31 performs processing opposite to the processing of step S25. More specifically, in step S27, the voltage control unit 31 increases the output of the semiconductor laser 42 having the oscillation wavelength of 660 nm and decreases the output of the semiconductor laser 43 having the oscillation wavelength of 440 nm.

If the dark portion potential VD(VG) for a color is less than or equal to the lower-limit value VDmin, the voltage control unit 31 decreases the quantity of laser light used for the exposure of this color and executes similar processing to update the setting value of grid bias voltage VG. The D/A converter 32 converts the laser output setting value (digital signal) into an analog signal and supplies the analog laser output signal to the exposure device 4. After step S27, processing continues at step S12.

If the dark portion potential VD for each color is within the range defined by the upper-limit value VDmax and the lower-limit value VDmin (YES in step S20 and YES in step S21), the voltage control unit 31 terminates the processing routine for controlling the dark portion potential VD of each color. If the charging potential of each color is within a predetermined range, the voltage control unit 31 stores the grid bias setting value VG finally determined for each color in its internal memory.

After the grid bias voltage VG and the laser output for each color are set in this manner, in step S22, the voltage control unit 31 calculates the development voltage VDC of respective colors applied to the developing sleeves 12*a*, 12*b*, and 12*c* of the developing devices 6*a*, 6*b*, and 6*c*. The D/A converter 32 converts the development voltage VDC (a digital setting value) into an analog signal and sets (supplies) the converted analog signal to the development bias voltage control circuits 35*a*, 35*b*, and 35*c*.

The voltage control unit 31 calculates the grid bias voltage VG and the development bias voltage VDC for each color, and terminates preparation for the image formation processing upon completing storage of the data required for all colors into the internal memory. The voltage control unit 31 terminates the pre-rotation and causes the image forming apparatus 1 to start the image formation processing.

If the image forming apparatus 1 starts the image formation processing, the voltage control unit 31 reads the grid bias voltage VG and the development bias voltage VDC for each color from the internal memory and sets (supplies) the read data to the high-voltage control units 33*a* and 33*b* and the development bias voltage control circuits 35*a*, 35*b*, and 35*c*.

Thus, in a state where the grid bias voltage VG and the development bias voltage VDC are applied, the image forming apparatus 1 performs image formation processing for only one color in the above-described manner and transfers the formed toner image onto the recording material P. Similarly, the image forming apparatus 1 forms toner images for other colors. The voltage control unit 31 changes the grid bias voltage VG and the development bias voltage VDC for each color. Upon completing the image formation for all three colors, the image forming apparatus 1 terminates the image formation processing and causes the photosensitive drum 2 to start post-rotation and stop it.

As described above, the durability of photosensitive drum 2 and output characteristics of the high-voltage control unit 33*a* are factors substantially limiting the upper-limit value of the charging potential for the image forming apparatus 1. Therefore, if the required latent image contrast VSC increases greatly due to deterioration in exposure sensitivity of the photosensitive drum 2 or due to highly-humid environmental conditions, only adjusting the grid bias voltage VG would be ineffective to attain a required level of development contrast $V_{CONT}$.

As illustrated in FIG. 6, in the early stage of the life cycle, the voltage control unit 31 can secure the required latent image contrast voltage VSC by increasing the dark portion potential VD while maintaining the laser output "a" at the same level. However, if the dark portion potential VD reaches the upper-limit value of −900V in the charging potential, the voltage control unit 31 cannot increase the dark portion potential VD any more to secure the required latent image contrast VSC. Thus, the voltage control unit 31 causes the exposure control unit 51 to increase the laser output of the exposure device 4 to secure the required latent image contrast VSC.

However, if the laser output of the exposure device 4 increases simply, the potential distribution of an electrostatic latent image at the exposure spot significantly varies compared to the distribution obtained when the laser output is low. Therefore, the developing devices 6*a*, 6*b*, and 6*c* cannot obtain similar results in development.

Hence, when the voltage control unit 31 instructs increasing the laser output (step S24 in FIG. 5), the exposure control unit 51 changes the intensity rate of the laser beam 42L relative to that of the laser beam 43L. More specifically, the exposure control unit 51 increases an output rate of the 440 nm laser beam 43L whose exposure spot has a narrow peak in light quantity and decreases an output rate of the 660 nm laser beam 42L having a wide peak in light quantity (step S25 in FIG. 5). Thus, the image forming apparatus 1 according to the first exemplary embodiment can form an electrostatic latent image in such a manner that the width of a developed line (laser spot diameter) at a laser output "b" illustrated in FIG. 6 is comparable to that at the laser output "a."

FIG. 6 illustrates an example relationship between the laser output and the light portion potential VL at dark portion potentials VD1 and VD2, in the early, middle, and late stages of the photosensitive drum life cycle. FIG. 6 illustrates a combination of the laser output and the dark portion potential VD capable of securing the same latent image contrast VSC throughout the early, middle, and late states in the photosensitive drum life cycle.

The exposure sensitivity of the photosensitive drum 2 gradually deteriorates if the number of repetitively performed charging and exposure operations increases. Thus, to secure the same latent image contrast VSC, the first exemplary embodiment increases the dark portion potential VD in both early and middle stages of the photosensitive drum life cycle as illustrated in FIG. 6.

However, in the middle stage of the life cycle, the dark portion potential VD reaches the upper-limit value. Thus, if the dark portion potential VD reaches the upper-limit value, the first exemplary embodiment gradually increases the laser output by an amount sufficient for compensating the deterioration in the exposure sensitivity of the photosensitive drum 2 (e.g., to secure the same latent image contrast VSC).

The following is an example image density control performed by the exposure device 4 illustrated in FIG. 2 which uses only the laser beam 42L emitted from the semiconductor laser 42 whose oscillation wavelength is 660 nm. In the early-middle stage of the life cycle, the gradient of a curve representing the dark portion potential VL at the laser output "a" of FIG. 6 remains substantially the same. Therefore, as illustrated in FIG. 7A, the in-plane potential distribution of an electrostatic latent image at the exposure spot formed on the surface of photosensitive drum 2 remains unchanged.

Thus, if the development voltage VDC is set for development processing, toner particles adhere to a hatched portion in the development processing. The size of a toner image resulting from the exposure spot remains unchanged. Accordingly, the thickness of a toner image representing a scanning line does not change when the toner image is formed by scanning the exposure spot. The density of an image formed when scanning lines are arrayed in the sub scanning direction does not change.

However, in the middle-late stage of the life cycle, as illustrated in FIG. 6, the first exemplary embodiment increases the laser output (increases the exposure level of an exposed portion subjected to multiple-exposure processing) to secure the required latent image contrast VSC. Therefore, the first exemplary embodiment uses a region where the gradient of a curve representing the dark portion potential VL at the laser output "b" is small.

Therefore, an electrostatic latent image at the exposure spot has a potential distribution greatly changing as illustrated in FIG. 7B. A toner image resulting from the exposure spot is enlarged if the development voltage VDC is set for the development. Accordingly, the toner image of a scanning line resulting from scanning of the exposure spot becomes thicker. The density of an image formed when scanning lines are arrayed in the sub scanning direction increases.

The exposure device according to the first exemplary embodiment includes two lasers which are identical in light emission level (same in quantity of light emission) and differentiated in beam spot diameter. The first exemplary embodiment changes a ratio in combination (exposure rate) between two lasers according to the endurance to acquire desired potential distribution of an electrostatic latent image.

The beam spot diameter represents a diameter of an area where the light quantity is in a $1/e^2$ level compared to the peak light quantity when the laser beam spot has an intensity distribution similar to the Gaussian distribution. In the following description, "diameter in main scanning direction×diameter in sub scanning direction" defines the beam spot diameter. Furthermore, the beam spot diameter of a laser beam is proportional to "$K \cdot F \cdot \lambda$" when K is a constant, F represents an F-number, and $\lambda$ represents an oscillation wavelength. Therefore, compared to a red color light emission semiconductor laser (680 nm and 780 nm), a blue color light emission semiconductor laser (405 nm and 420 nm) can reduce the beam spot diameter to the level of 50% if an optical unit has the same F-number.

In general, if the light emission level (light emission quantity) of a laser is changed, the beam spot of the laser changes correspondingly. The first exemplary embodiment has a plurality of lasers having different spot diameters and can appropriately perform density adjustment while suppressing variation in beam spot even if the quantity of light emission is changed.

More specifically, according to the first exemplary embodiment, the exposure control unit 51 (as illustrated in FIG. 2) adjusts both a driving rate of the semiconductor laser 42 having the oscillation wavelength of 660 nm and a driving rate of the semiconductor laser 43 having the oscillation wavelength of 440 nm when both of these lasers 42 and 43 are driven according to the same image signal. Thus, as illustrated in FIG. 7C, this exemplary embodiment can reduce the peak width of an in-plane distribution of exposure amount at the exposure spot and can acquire the potential distribution of an electrostatic latent image in the middle-late stage which is similar to that in the early-middle stage illustrated in FIG. 7A.

FIG. 7C illustrates an output of the semiconductor laser 42 having the oscillation wavelength of 660 nm and an output of the semiconductor laser 43 having the oscillation wavelength of 440 nm in the double exposure using these lasers 42 and 43. The semiconductor laser 43 having the oscillation wavelength of 440 nm can reduce the exposure spot diameter to the level of approximately 50% compared to the semiconductor laser 42 having the oscillation wavelength of 660 nm. Therefore, a reproduced potential distribution in FIG. 7C becomes similar, as a whole, to the electrostatic latent image illustrated in FIG. 7A. In the case of FIG. 7B, only the 660 nm-semiconductor laser 42 is used and the quantity of light is doubled compared to the value in FIG. 7A.

The first exemplary embodiment activates only the laser beam 42L having the oscillation wavelength of 660 nm in the early-middle stage of the photosensitive drum life cycle as illustrated in FIG. 7A. Then, if a calculated value of the grid bias voltage VG exceeds the upper-limit value and the voltage control unit 31 determines to increase the laser output, the exposure control unit 51 starts using both the laser beam 42L and the laser beam 43L. The exposure control unit 51 activates the semiconductor laser 43 having the oscillation wavelength of 440 nm based on a PWM modulated image signal similar to that for the semiconductor laser 42. The exposure control unit 51 causes the semiconductor laser 43 to write gradation of each pixel along a scanning line.

Accordingly, the surface of photosensitive drum 2 is scanned by both the laser beam 42L and the laser beam 43L. Namely, the surface of photosensitive drum 2 is exposed to a combined exposure spot which can be formed by placing the exposure spots of the laser beam 43L and the laser beam 42L one upon another.

Then, the exposure control unit 51 increases the light emission intensity of the semiconductor laser 43 having the oscillation wavelength of 440 nm (step S25 in FIG. 5) according to an increase in combined laser output obtained by the multiple-exposure processing. Namely, the exposure control unit 51 increases an output rate of the semiconductor laser 43 relative to an output rate of the semiconductor laser 42.

In determining the output rate for each laser, the exposure control unit 51 can take account of exposure-potential characteristics (EV characteristics) of the photosensitive drum 2, an increased range in the laser output, and line width in an output image. A change amount of the rate is stored in the internal memory of the exposure control unit 51 in which the change amount of the rate is associated with a correction amount of the laser output.

In the first exemplary embodiment, a maximum value of the combined laser output is set to twice a standard laser output applied to the early-middle stage of the life cycle. Namely, the quantity of light can be doubled. If the quantity of light is doubled, the exposure control unit 51 allocates a half of the combined laser output to the semiconductor laser 43 having the oscillation wavelength of 440 nm. Thus, the reproduction of a thin line image in the late stage of the life cycle becomes similar to that in the early-middle stage.

As illustrated in FIG. 2, the semiconductor lasers 42 and 43 emit the laser beams 42L and 43L (having adjusted intensity rates as described above) and the corresponding collimator lens 44 and 45 convert these laser beams 42L and 43L into parallel beams. The parallel beam of the laser beam 43L passes the reflection mirror 47 and is combined with the parallel beam of the laser beam 42L when it passes the half mirror 46. Both the parallel laser beam 43L and the parallel laser beam 42L travel on the same optical path once they approach the optical deflector 48 as illustrated. A deflection surface 48*a* of the optical deflector 48 reflects the combined light beam. The image forming optical unit 49 guides the combined light beam to the photosensitive drum 2.

The optical deflector 48 rotates in the direction of an arrow A to cause the light to perform scanning on the surface of photosensitive drum 2 in the direction of an arrow B (main scanning direction). Simultaneously, the photosensitive drum 2 rotates intermittently in increments of a predetermined angle in the sub scanning direction (indicated by an arrow C). Thus, the laser beams 42L and 43L having been optically modulated according to image information can perform 2-dimensional scanning on the surface of photosensitive drum 2. Thus, an electrostatic latent image reflecting the image information is formed on the surface of photosensitive drum 2.

As described above, the first exemplary embodiment uses two laser sources having different oscillation wavelengths and performs image formation processing using the semiconductor laser 42 having the oscillation wavelength of 660 nm in a region where the gradient of photosensitive member sensitivity characteristics (EV characteristics) does not change as illustrated in FIG. 6. Furthermore, if required to increase the laser output by an amount sufficient for securing the latent image contrast VSC, the first exemplary embodiment performs image formation processing using the laser beam 43L of the semiconductor laser 43 having the oscillation wavelength of the 440 nm in addition to the laser beam 42L of the semiconductor laser 42. Thus, the first exemplary embodiment can perform image formation processing for a long term with the constant potential distribution of an electrostatic latent image at the exposure spot.

In short, according to a conventional system, to maintain a constant image (in particular, constant thin line width), and to prevent any malfunction of a memory provided for a photosensitive member, it is required to set each of the laser output and the charging potential within a predetermined range.

Thus, a conventional system cannot operate properly if any change occurs in environmental conditions, colors, and the density due to long-term usage. In view of the above situations, the first exemplary embodiment provides a potential control and an exposure control method capable of obtaining a stable and highly-accurate image.

According to the first exemplary embodiment, the image forming apparatus 1 includes a plurality of laser sources having different oscillation wavelengths and configured to perform multiple-exposure processing placing laser spots one upon another. The image forming apparatus 1 changes conditions for combining outputs of two laser beams to adjust the diameter of a combined exposure spot and the exposure intensity distribution. In this case, the first exemplary embodiment takes account of usage history of the image forming apparatus 1, sensitivity change of the photosensitive drum 2, detection result of the surface potential sensor 5, and charging potential in adjusting the diameter of a combined exposure spot and the exposure intensity distribution.

Thus, the image forming apparatus 1 can obtain a stable and high-accurate image while maintaining the constant potential distribution of an electrostatic latent image for a long term regardless of conditional changes during usage of the image forming apparatus 1 (e.g., exposure sensitivity of the photosensitive drum 2, charging potential, and the combined laser output).

Furthermore, the image forming apparatus 1 exposes the charged surface of a photosensitive member to a plurality of laser beams whose exposure spots are placed on the same position while changing the combination conditions of the radiation intensities, causes the surface potential sensor to detect the light portion potential and the dark portion potential, and determines radiation conditions of the plurality of laser beams based on the detection result. More specifically, the image forming apparatus 1 increases the exposure rate of a short-wavelength laser source considering usage history of the image forming apparatus 1. Thus, the image forming apparatus 1 can extend the life of the photosensitive member.

Second Exemplary Embodiment

Figure 8:
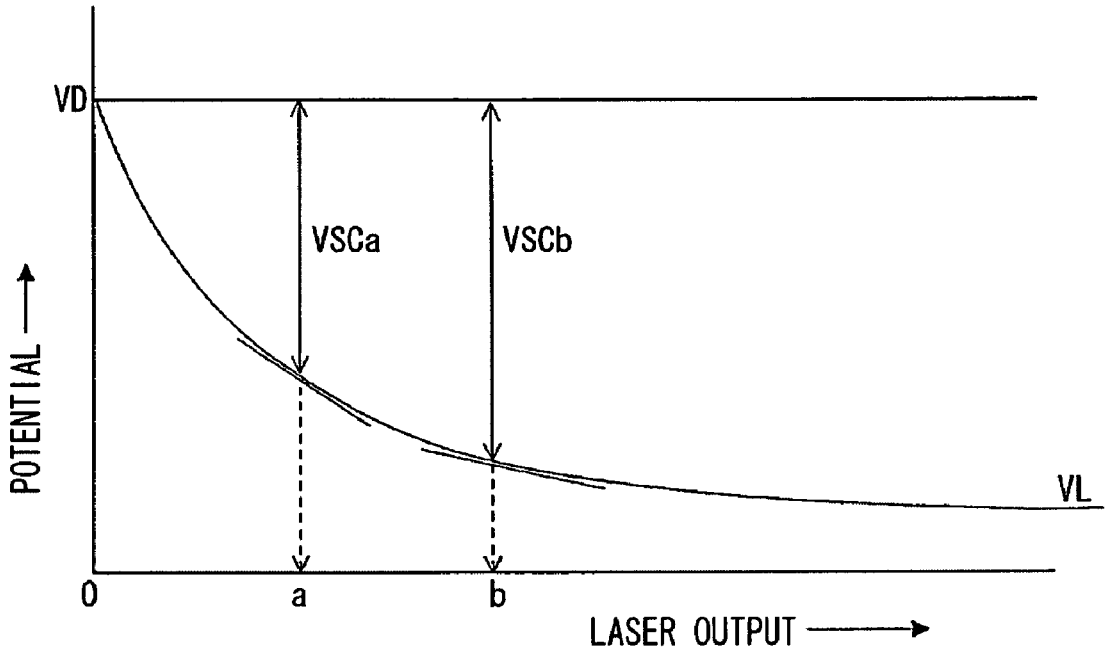
FIG. 8 is a graph illustrating sensitivity characteristics of a photosensitive member in a state where dark portion potential is constant and a laser output is variable.
Figure 9A:
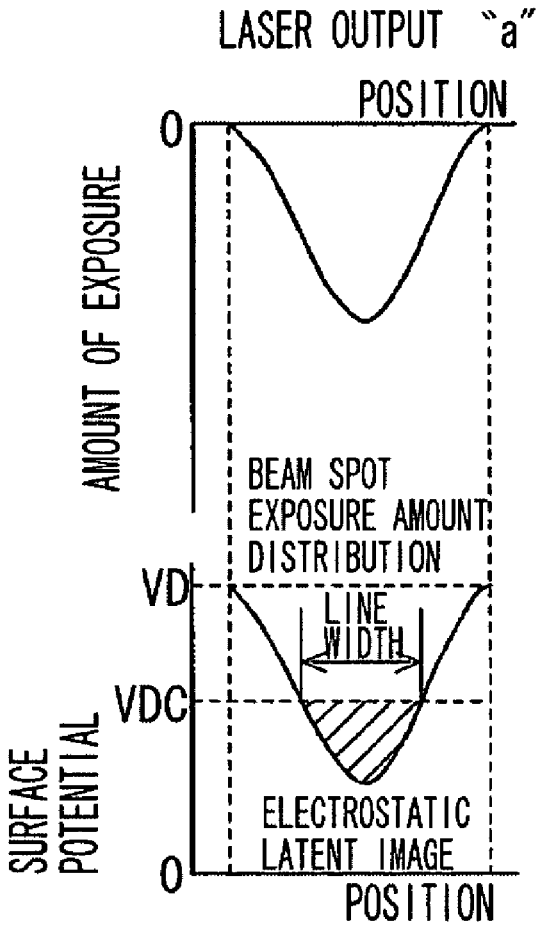
FIGS. 9A and 9B illustrate examples of latent image profiles according to different laser outputs.
Figure 9B:
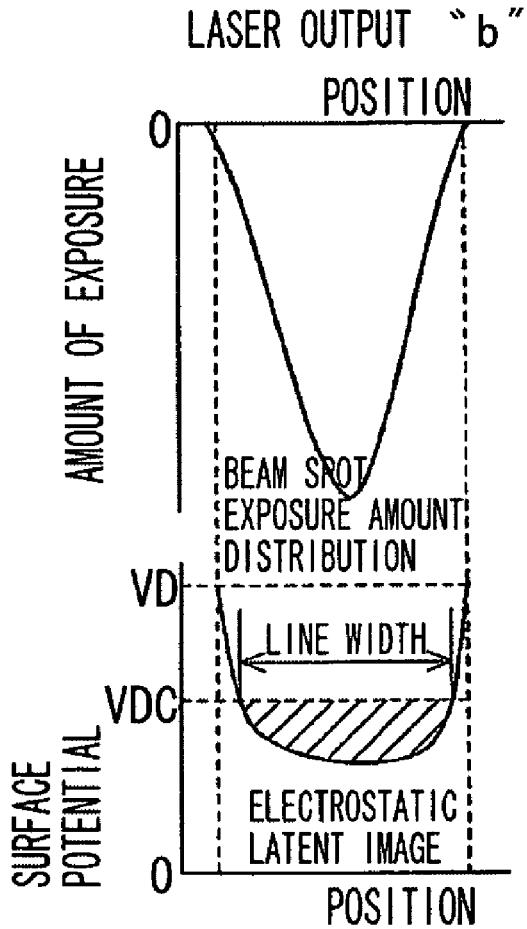

FIG. 8 illustrates sensitivity characteristics of a photosensitive member in a state where the dark portion potential is constant and the laser output is variable. FIGS. 9A and 9B illustrate example latent image profiles according to different laser outputs.

In the second exemplary embodiment, the exposure control unit 51 increases the rate of the laser beam 43L relative to a total exposure amount according to an increase in the cumulative exposure amount (the number of image formations) of the photosensitive drum 2.

The image density control performed by the image forming apparatus 1 is not limited to the method described in the first exemplary embodiment that detects an output of the surface potential sensor 5 while changing the charging potential during the pre-rotation of the photosensitive drum 2. An another exemplary image density control includes providing a unit configured to detect the density of a toner image on the photosensitive drum 2, causing the primary charging device 3 to maintain the charging potential of the photosensitive drum 2 at a constant level, and adjusting an image density according to laser radiation conditions of the exposure device 4.

Hence, the second exemplary embodiment changes the laser output of the exposure device 4 according to the latent image contrast VSC that greatly varies in each of the developing devices 6*a*, 6*b*, and 6*c* or in each absolute humidity hum_abs obtained from an output of the temperature/humidity sensor 37.

As illustrated in FIG. 8, if a detected image density at the latent image contrast VSCa corresponding to the laser output "a" is insufficient, the voltage control unit 31 secures a required level of latent image contrast VSCb by setting a laser output "b" while maintaining the dark portion potential VD at a constant level.

In this case, as illustrated in FIGS. 9A and 9B, the size of a latent image spot formed by the laser output "a" and developed by the development voltage VDC is greatly different from the size of a latent image spot formed by the laser output "b" and developed by the development voltage VDC. The change of light portion potential VL relative to the exposure amount in the vicinity of the laser output "b" illustrated in FIG. 8 is moderate compared to the change in the vicinity of the laser output "a." As a result, the light quantity peak of a developed exposure spot has a wide skirt portion as illustrated in FIG. 9B. If the development width of a latent image spot becomes larger, the toner image of a scanning line becomes thicker. If the clearance between scanning lines decreases due to the bold toner image of a scanning line, the apparent image density changes.

In other words, as illustrated in FIG. 8, if the gradient of a curve representing the photosensitive member characteristics changes depending on the laser output level, the line width of a thin line image changes undesirably. FIGS. 9A and 9B illustrate a comparison between latent image profiles corresponding to spot light quantity distributions resulting from laser beam exposure.

In a large gradient region corresponding to the laser output "a", the light portion potential VL is sensitive to the exposure amount. The potential distribution of an electrostatic latent image accurately reproduces the in-spot light quantity distribution. On the other hand, in a region corresponding to the laser output "b" where the sensitivity of the light portion potential VL relative to the exposure amount is relatively low, the potential distribution of an electrostatic latent image becomes bold regardless of change in the in-spot light quantity.

The exposure sensitivity of the photosensitive drum 2 gradually deteriorates due to various reasons (e.g., optical fatigue) in accordance with an increase in the cumulative time of usage. In this case, if the dark portion potential VL is fixed, the system increases the laser output to secure a required level of latent image contrast. The region used in this case is a region where the sensitivity of the light portion potential VL relative to the exposure amount is low. Therefore, the potential distribution of an electrostatic latent image becomes thicker.

Hence, according to the second exemplary embodiment, the exposure control unit 51 (as illustrated in FIG. 2) adjusts both a driving rate of the semiconductor laser 42 having the oscillation wavelength of 660 nm and a driving rate of the semiconductor laser 43 having the oscillation wavelength of 440 nm according to a combined laser output when both of these semiconductor lasers 42 and 43 are driven according to the same image signal.

More specifically, the exposure control unit 51 increases an exposure rate of a short-wavelength laser source in accordance with an increase in the cumulative time of usage of the image forming apparatus 1. Thus, as illustrated in FIG. 7C, the peak width of an exposure amount distribution at the exposure spot gradually decreases according to an increase in the laser output. Thus, the potential distribution of an electrostatic latent image according to this exemplary embodiment becomes similar to that corresponding to the laser output "a" illustrated in FIG. 9A.

Third Exemplary Embodiment

Figure 10:
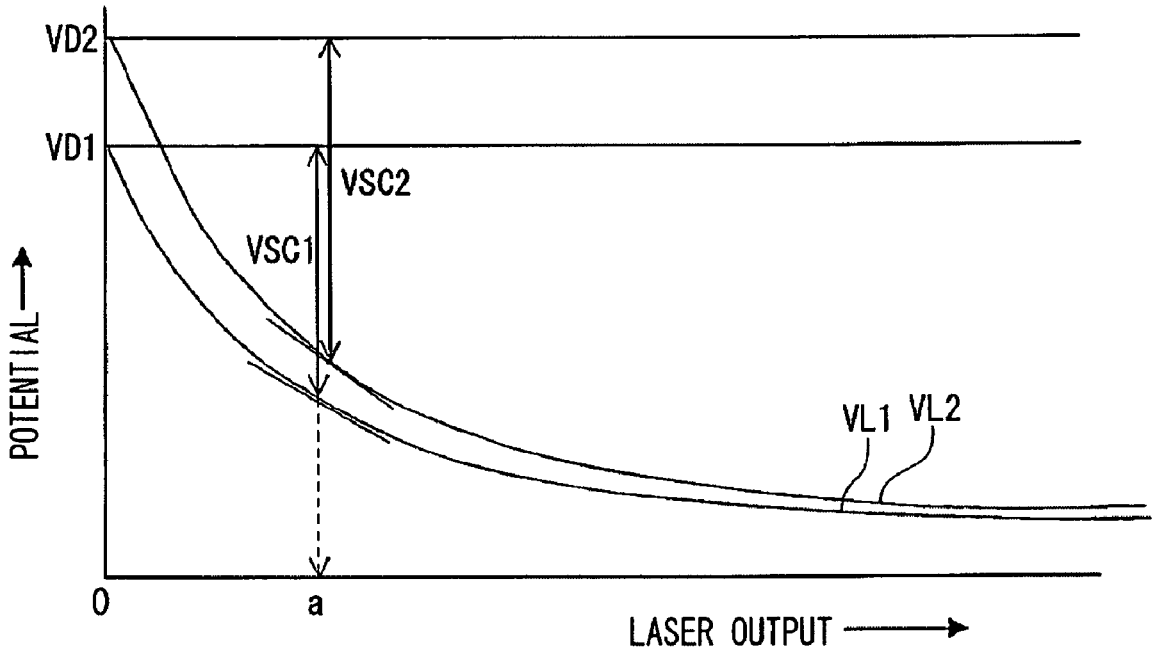
FIG. 10 is a graph illustrating sensitivity characteristics of a photosensitive member in a state where a laser output is constant and dark portion potential is variable.

FIG. 10 illustrates sensitivity characteristics of a photosensitive member in a state where the laser output is constant and the dark portion potential is variable.

In a third exemplary embodiment, to stabilize the density of a formed toner image, the exposure control unit 51 decreases the exposure rate of the semiconductor laser 43 if the charging device increases the charging potential of the photosensitive drum 2 according to the number of image formations or a cumulative exposure time. The exposure control unit 51, if the charging potential on the surface of photosensitive drum 2 is increased by the primary charging device 3, starts decreasing an exposure amount from the laser beam 43L relative to the total exposure amount.

The image density control for the image forming apparatus 1 can be realized by providing a unit configured to detect the density of a toner image on the photosensitive drum 2, maintaining constant laser radiation conditions for the exposure device 4, and causing the primary charging device 3 to adjust the charging potential of the photosensitive drum 2.

Hence, the third exemplary embodiment causes the primary charging device 3 to change the charging potential for the photosensitive drum 2 according to the latent image contrast VSC that greatly changes in each of the developing devices 6*a*, 6*b*, and 6*c* or in each value of absolute humidity hum_abs obtained from an output of the temperature/humidity sensor 37. In this case, as described in the first exemplary embodiment, the latent image contrast VSC can be set to a desired value in a region where the gradient of a curve representing the photosensitive member sensitivity characteristics (EV characteristics) is relatively similar.

However, even if the laser output is the same, the gradient in the photosensitive member sensitivity characteristics (EV characteristics) varies slightly if the charging potential changes from a high value to a low value or vice versa. Therefore, the potential distribution of an electrostatic latent image varies slightly. Namely, in view of a recent need for a high-accurate and high-stable image, an image formed when the charging potential is high may not be identical with an image formed when the charging potential is low.

It is now assumed that, because a detected image density is insufficient, the voltage control unit 31 secures a required latent image contrast VSC2 by increasing the dark portion potential from VD1 to VD2 at the laser output "a" as illustrated in FIG. 10. In this case, if only the semiconductor laser 42 having the oscillation wavelength of 660 nm is used, the peak width in the potential distribution of an electrostatic latent image at the exposure spot becomes narrower because the gradient of light portion potential VL2 is larger than the gradient of light portion potential VL1. The line width of a developed thin line is slim.

Hence, in the third exemplary embodiment, the exposure control unit 51 (as illustrated in FIG. 2) adjusts both a driving rate of the semiconductor laser 42 having the oscillation wavelength of 660 nm and a driving rate of the semiconductor laser 43 having the oscillation wavelength of 440 nm with reference to Table 3 when both of these lasers 42 and are driven according to the same image signal. Thus, this exemplary embodiment can adjust the peak width in the in-plane distribution of exposure amount at the exposure spot and can reduce a difference in the latent image profile of dark portion potential VD.

TABLE 3

| LASER OUTPUT RATE CORRESPONDING TO LATENT IMAGE CONTRAST REQUIRED | |
|---|---|
| Vcont(V) | 440 nm LASER OUTPUT RATE |
| 500 | 75 |
| 495 | 76 |
| 490 | 77 |
| 485 | 78 |
| 480 | 79 |
| 475 | 80 |
| 470 | 81 |
| 465 | 82 |
| 460 | 83 |
| 455 | 84 |
| 450 | 85 |
| 445 | 86 |
| 440 | 87 |
| 435 | 88 |
| 430 | 89 |
| 425 | 90 |
| 420 | 91 |
| 415 | 92 |
| 410 | 93 |
| 405 | 94 |
| 400 | 95 |
| 395 | 96 |
| 390 | 97 |
| 385 | 98 |
| 380 | 99 |
| 375 | 100 |
| 370 | 100 |
| 365 | 100 |
| 360 | 100 |
| 355 | 100 |
| 350 | 100 |
| 345 | 100 |
| 340 | 100 |

Table 3 is a conversion table listing driving rates for the semiconductor laser 43 having the oscillation wavelength of 440 nm corresponding to the required latent image contrast VSC. The internal memory of the exposure control unit 51 stores numerical values on Table 3. The driving rate for the semiconductor laser 42 having the oscillation wavelength of 660 nm can be obtained by subtracting a corresponding value on Table 3 from 100 (=the whole sum).

As illustrated in FIG. 1, the voltage control unit 31 calculates the required latent image contrast VSC based on an output of the temperature/humidity sensor 37 and transmits required latent image contrast VSC to the exposure control unit 51 illustrated in FIG. 2. The exposure control unit 51 performs output setting according to the received latent image contrast VSC with reference to Table 3 for each of the semiconductor laser 42 having the oscillation wavelength of 660 nm and the semiconductor laser 43 having the oscillation wavelength of 440 nm.

As illustrated in FIG. 10, if the dark portion potential VD is raised to increase the latent image contrast VSC, the apparent exposure sensitivity of the photosensitive drum 2 becomes higher and the potential distribution of an electrostatic latent image becomes steep and has a narrow peak width even when the exposure spot is the same. Accordingly, a developed exposure spot becomes smaller and a toner image has a thin line width. Therefore, if the latent image contrast VSC is increased, the setting according to Table 3 increases the output rate of the 660 nm-semiconductor laser 42 to enlarge the exposure spot and increase the line width of a toner image.

More specifically, in the image forming apparatus 1 which can change the charging potential according to a latent image contrast required to maintain the density of an output image, the exposure intensity of a long-wavelength laser is relatively increased if the charging potential is high. Thus, this embodiment can realize an overall adjustment of exposure intensity.

Fourth Exemplary Embodiment

The control according to a fourth exemplary embodiment is a combination of the laser output control described in the second exemplary embodiment and the output rate control for the semiconductor lasers 42 and 43 based on a required latent image contrast described in the third exemplary embodiment.

As illustrated in FIG. 1, the voltage control unit 31 calculates the required latent image contrast VSC based on an output of the temperature/humidity sensor 37 and transmits the required latent image contrast VSC to the exposure control unit 51 illustrated in FIG. 2. The exposure control unit 51 performs output setting according to the received latent image contrast VSC and the combined laser output setting for the semiconductor lasers 42 and 43 (000~255) with reference to Table 4 for each of the semiconductor laser 42 having the oscillation wavelength of 660 nm and the semiconductor laser 43 having the oscillation wavelength of 440 nm.

The driving rate for the semiconductor laser 42 having the oscillation wavelength of 660 nm can be obtained by subtracting a corresponding value on Table 4 from 100 (=the whole sum).

Fifth Exemplary Embodiment

Figure 11:
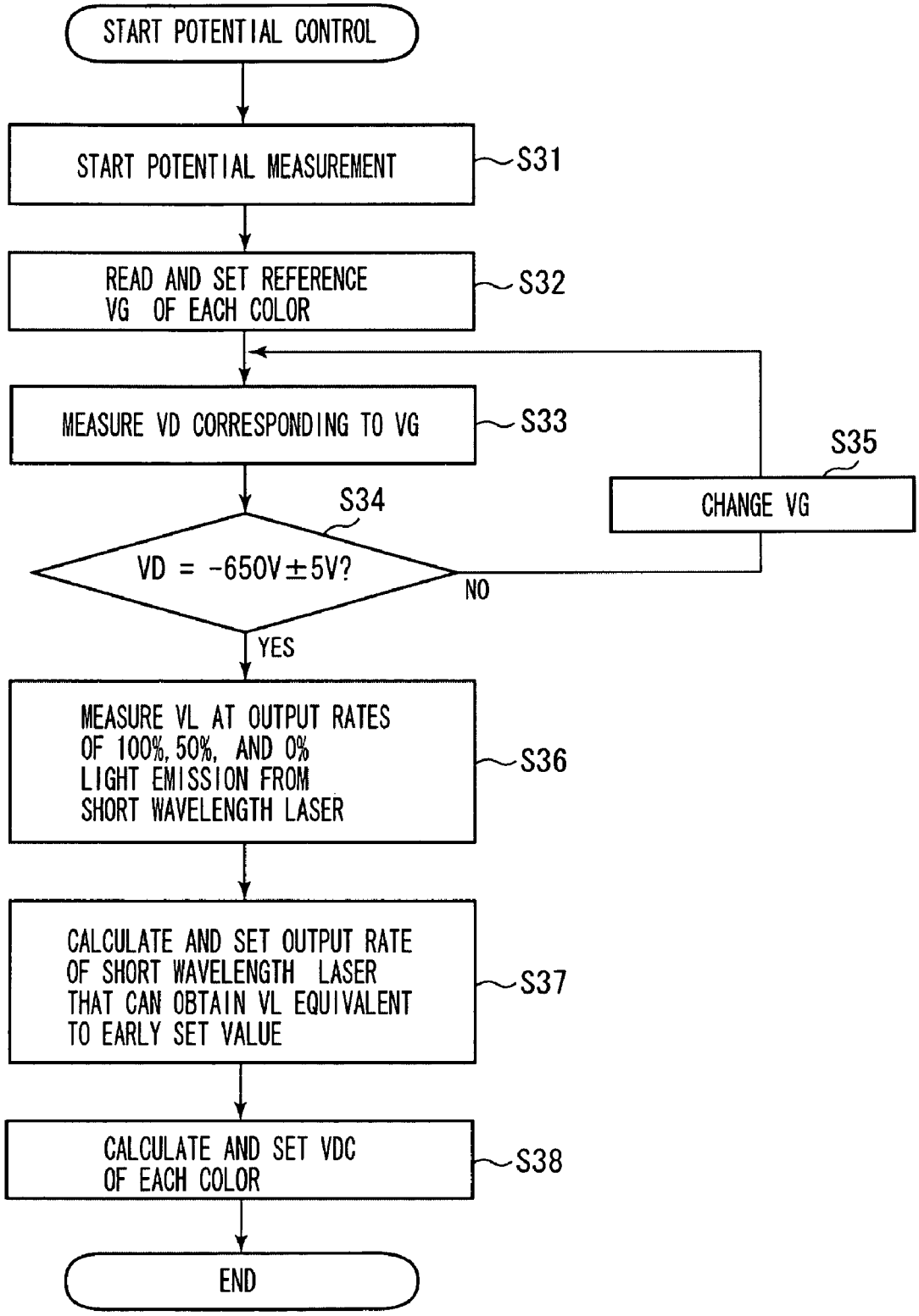
FIG. 11 is a flowchart illustrating an example of processing for controlling charging potential and an exposure output according to a fifth exemplary embodiment of the present invention.

FIG. 11 is a flowchart illustrating an example of processing for controlling the charging potential and the exposure output according to a fifth exemplary embodiment.

In the fifth exemplary embodiment, the spectral sensitivity of photosensitive drum 2 is lower at a second laser wavelength compared to a value at a first laser wavelength. In accordance with an increase in cumulative exposure amount of the photosensitive drum 2, the exposure control unit 51 decreases the exposure rate of the semiconductor laser 43 at an exposed portion where one exposure spot is placed on another.

Two laser beams 42L and 43L are mutually different in wavelength band of light. The laser beam 43L has a wavelength shorter than that of the laser beam 42L. The exposure control unit 51 changes a ratio of the laser beam 43L to the total exposure amount of the laser beams 42L and 43L according to an endurance state of the photosensitive drum 2.

The above-described ratio control by the exposure control unit 51 can prevent the size of a toner image of an exposure point from being changed.

The fifth exemplary embodiment can constantly stabilize the image quality and realize a long-term usage of a photo-

TABLE 4

INTENSITY RATIO OF 440 nm LASER SORRESPONDING TO REQUIRED LATENT IMAGE CONTRAST AND ENTIRE LASER LIGHT QUANTITY SIGNAL VALUE

| | LASER LIGHT QUANTITY SIGNAL VALUE | | | | | | | | | | | | | | | | |
|---|---|---|---|---|---|---|---|---|---|---|---|---|---|---|---|---|---|
| Vcont(V) | 128 | 136 | 144 | 152 | 160 | 168 | 176 | 184 | 192 | 200 | 208 | 216 | 224 | 232 | 240 | 248 | 255 |
| 500 | 50 | 50 | 50 | 52 | 54 | 56 | 58 | 60 | 62 | 64 | 66 | 68 | 70 | 72 | 74 | 76 | 78 |
| 495 | 50 | 50 | 50 | 52 | 54 | 56 | 58 | 60 | 62 | 64 | 66 | 68 | 70 | 72 | 74 | 76 | 78 |
| 490 | 50 | 50 | 50 | 52 | 54 | 56 | 58 | 60 | 62 | 64 | 66 | 68 | 70 | 72 | 74 | 76 | 78 |
| 485 | 50 | 50 | 50 | 52 | 54 | 56 | 58 | 60 | 62 | 64 | 66 | 68 | 70 | 72 | 74 | 76 | 78 |
| 480 | 50 | 50 | 50 | 52 | 54 | 56 | 58 | 60 | 62 | 64 | 66 | 68 | 70 | 72 | 74 | 76 | 78 |
| 475 | 51 | 51 | 51 | 53 | 55 | 57 | 59 | 61 | 63 | 65 | 67 | 69 | 71 | 73 | 75 | 77 | 79 |
| 470 | 52 | 52 | 52 | 54 | 56 | 58 | 60 | 62 | 64 | 66 | 68 | 70 | 72 | 74 | 76 | 78 | 80 |
| 465 | 53 | 53 | 53 | 55 | 57 | 59 | 61 | 63 | 65 | 67 | 69 | 71 | 73 | 75 | 77 | 79 | 81 |
| 460 | 54 | 54 | 54 | 56 | 58 | 60 | 62 | 64 | 66 | 68 | 70 | 72 | 74 | 76 | 78 | 80 | 82 |
| 455 | 55 | 55 | 55 | 57 | 59 | 61 | 63 | 65 | 67 | 69 | 71 | 73 | 75 | 77 | 79 | 81 | 83 |
| 450 | 56 | 56 | 56 | 58 | 60 | 62 | 64 | 66 | 68 | 70 | 72 | 74 | 76 | 78 | 80 | 82 | 84 |
| 445 | 57 | 57 | 57 | 59 | 61 | 63 | 65 | 67 | 69 | 71 | 73 | 75 | 77 | 79 | 81 | 83 | 85 |
| 440 | 58 | 58 | 58 | 60 | 62 | 64 | 66 | 68 | 70 | 72 | 74 | 76 | 78 | 80 | 82 | 84 | 86 |
| 435 | 59 | 59 | 59 | 61 | 63 | 65 | 67 | 69 | 71 | 73 | 75 | 77 | 79 | 81 | 83 | 85 | 87 |
| 430 | 60 | 60 | 60 | 62 | 64 | 66 | 68 | 70 | 72 | 74 | 76 | 78 | 80 | 82 | 84 | 86 | 88 |
| 425 | 61 | 61 | 61 | 63 | 65 | 67 | 69 | 71 | 73 | 75 | 77 | 79 | 81 | 83 | 85 | 87 | 89 |
| 420 | 62 | 62 | 62 | 64 | 66 | 68 | 70 | 72 | 74 | 76 | 78 | 80 | 82 | 84 | 86 | 88 | 90 |
| 415 | 63 | 63 | 63 | 65 | 67 | 69 | 71 | 73 | 75 | 77 | 79 | 81 | 83 | 85 | 87 | 89 | 91 |
| 410 | 64 | 64 | 64 | 66 | 68 | 70 | 72 | 74 | 76 | 78 | 80 | 82 | 84 | 86 | 88 | 90 | 92 |
| 405 | 65 | 65 | 65 | 67 | 69 | 71 | 73 | 75 | 77 | 79 | 81 | 83 | 85 | 87 | 89 | 91 | 93 |
| 400 | 66 | 66 | 66 | 68 | 70 | 72 | 74 | 76 | 78 | 80 | 82 | 84 | 86 | 88 | 90 | 92 | 94 |
| 395 | 67 | 67 | 67 | 69 | 71 | 73 | 75 | 77 | 79 | 81 | 83 | 85 | 87 | 89 | 91 | 93 | 95 |
| 390 | 68 | 68 | 68 | 70 | 72 | 74 | 76 | 78 | 80 | 82 | 84 | 86 | 88 | 90 | 92 | 94 | 96 |
| 385 | 69 | 69 | 69 | 71 | 73 | 75 | 77 | 79 | 81 | 83 | 85 | 87 | 89 | 91 | 93 | 95 | 97 |
| 380 | 70 | 70 | 70 | 72 | 74 | 76 | 78 | 80 | 82 | 84 | 86 | 88 | 90 | 92 | 94 | 96 | 98 |
| 375 | 71 | 71 | 71 | 73 | 75 | 77 | 79 | 81 | 83 | 85 | 87 | 89 | 91 | 93 | 95 | 97 | 99 |
| 370 | 72 | 72 | 72 | 74 | 76 | 78 | 80 | 82 | 84 | 86 | 88 | 90 | 92 | 94 | 96 | 98 | 100 |
| 365 | 73 | 73 | 73 | 75 | 77 | 79 | 81 | 83 | 85 | 87 | 89 | 91 | 93 | 95 | 97 | 99 | 100 |
| 360 | 74 | 74 | 74 | 76 | 78 | 80 | 82 | 84 | 86 | 88 | 90 | 92 | 94 | 96 | 98 | 100 | 100 |
| 355 | 75 | 75 | 75 | 77 | 79 | 81 | 83 | 85 | 87 | 89 | 91 | 93 | 95 | 97 | 99 | 100 | 100 |
| 350 | 76 | 76 | 76 | 78 | 80 | 82 | 84 | 86 | 88 | 90 | 92 | 94 | 96 | 98 | 100 | 100 | 100 |
| 345 | 77 | 77 | 77 | 79 | 81 | 83 | 85 | 87 | 89 | 91 | 93 | 95 | 97 | 99 | 100 | 100 | 100 |
| 340 | 78 | 78 | 78 | 80 | 82 | 84 | 86 | 88 | 90 | 92 | 94 | 96 | 98 | 100 | 100 | 100 | 100 |

Table 4 is a conversion table listing driving rates for the semiconductor laser 43 having the oscillation wavelength of 440 nm corresponding to each combination of the required latent image contrast VSC and a combined laser output setting for the semiconductor lasers 42 and 43. Similar to the third exemplary embodiment, the internal memory of the exposure control unit 51 stores numerical values on Table 4.

sensitive member even if aging deterioration occurs in the spectral sensitivity of a photosensitive member that varies depending on the wavelength band. For example, if a photosensitive member is used for a long term, the sensitivity deterioration appears in a low wavelength region near 400 nm and does not appear in the vicinity of the wavelength region of 700 nm. This is because the transmittance and absorptance of a specific wavelength vary due to optical fatigue occurring in the photosensitive member or particles adhering to a surface layer.

In the fifth exemplary embodiment, as illustrated in FIG. 2, the semiconductor laser 43 having the oscillation wavelength of 440 nm is used as the standard laser of the exposure device 4. However, the exposure sensitivity of the photosensitive drum 2 starts deteriorating in the short wavelength region. The change of exposure sensitivity in the photosensitive drum 2 tends to appear in the short wavelength region in the early stage of the life cycle and after usage of 100 k sheets or 200 k sheets. Therefore, the exposure control unit 51 increases an irradiation rate of the semiconductor laser 42 having the oscillation wavelength of 660 nm (i.e., a long-wavelength laser) according to an increase in cumulative exposure time.

More specifically, in performing the potential control described in the first exemplary embodiment, the processing includes measuring the light portion potential VL at three levels of 100%, 50%, and 0% in exposure intensity rate of the 440 nm laser while maintaining the charging potential at a constant level and using a rate capable of obtaining a light portion potential VL substantially similar to that obtained in the early stage of the life cycle of the photosensitive drum 2.

As illustrated in FIG. 11 and with reference to FIG. 1, in step S31, the voltage control unit 31 starts a potential measurement. In step S32, the voltage control unit 31 reads and sets reference grid potential VG=700V for each color.

In step S33, to adjust the charging potential to −650V (standard value), the voltage control unit 31 first sets the grid potential of the primary charging device 3 to −700V and causes the surface potential sensor 5 to measure a dark portion potential VD.

In step S34, the voltage control unit 31 determines whether the measurement value VD is within a range of −650V±5V. If the measurement value VD is out of the range of −650V±5V (NO in step S34), the control flow proceeds to step S35. In step S35, the voltage control unit 31 sets a new grid potential that reflects a difference ΔV between the measurement value VD and the standard value −650V, and returns to step S33.

Then, in step S33, the voltage control unit 31 again causes the surface potential sensor 5 to measure the dark portion potential VD. The voltage control unit 31 repeats the processing of steps S33 to S35 until the measurement value VD falls within the range of −650V±5V. If the measurement value VD is within the range of −650V±5V (YES in step S34), the control flow proceeds to step S36.

In step S36, the voltage control unit 31 performs measurement of the light portion potential VL at three levels of 100%, 50%, and 0% in exposure intensity rate of the semiconductor laser 43 having the oscillation wavelength of 440 nm.

In step S37, the voltage control unit 31 calculates a linear interpolated rate that can obtain an early set potential (−200V) when the exposure intensity rate of the semiconductor laser 43 having the oscillation wavelength of 440 nm is 100%. In step S38, the voltage control unit 31 calculates and sets the development voltage VDC of the each color. The voltage control unit 31 performs similar potential control based on the set exposure rate.

According to the above-described arrangement, the semiconductor laser 42 having the oscillation wavelength of 660 nm gradually increases its output rate according to the cumulative time of usage of the image forming apparatus 1. More specifically, this exemplary embodiment gradually increases the exposure rate of a long-wavelength laser source according to usage history of the image forming apparatus 1.

Thus, the fifth exemplary embodiment can maintain adequate formation of an image under a constant charging potential regardless of deteriorated exposure sensitivity of photosensitive drum 2. Thus, the life of the photosensitive drum 2 can be extended. Accordingly, this exemplary embodiment is useful if required to maintain a constant charging potential due to various restrictions (e.g., photosensitive member memory, high-voltage, and endurance).

According to another exemplary embodiment, three or more semiconductor lasers having mutually different oscillation wavelengths can be used to appropriately adjust the potential distribution of an electrostatic latent image at the exposure spot.

Furthermore, if the image forming apparatus 1 includes a counter that can obtain usage history information (e.g., number of rotations of the drum, cumulative pixel number of a formed image, and total number of formed images), the voltage control unit 31 can adjust output rates of a plurality of semiconductor lasers having different oscillation wavelengths according to the obtained usage history information.

Regarding the potential control, in addition to the methods described in the above embodiments, the output rates of a plurality of semiconductor lasers having different oscillation wavelengths can be adjusted, for example, by a user.

For example, a manual setting unit can be provided so that a user can select intensity rates of two types of laser beams and can manually set radiation conditions of a plurality of laser beams. If the input unit is provided, a user can change the combination of radiation intensities of a plurality of laser beams according to an output image. In other words, a user can directly perform adjustment of an image.

The image forming apparatus 1 according to the exemplary embodiments can include a manual setting unit configured to enable a user to manually select and set intensity rates of two laser beams (42L, 43L).

For example, an operation panel of the image forming apparatus 1 includes a button that enables a user to manually set a desired thickness for a thin line in a stepwise fashion and enables the user to operate the button while checking a test chart printed by the image forming apparatus 1. For example, the image forming apparatus 1 includes a switch provided on a main operation panel that includes a mode for enabling a user to freely change output rates of a plurality of semiconductor lasers having different oscillation wavelengths to adjust the thickness of a thin line according to an output image on a test chart.

According to the above-described first exemplary embodiment, semiconductor lasers having different oscillation wavelengths are laser sources differentiated in spot diameter (size). According to other exemplary embodiments, two or more laser sources having the same oscillation wavelength can be used if the laser sources are differentiated in spot diameter (size).

As described above, the line width of an image may vary if only the image density is adjusted among image formation conditions (exposure amount, development voltage, etc.) while disregarding the potential distribution of an electrostatic latent image at the exposure spot. On the other hand, the gradation in the image density and the color tone expression on a full-color image may partly deteriorate if the line width of an image is adjusted while disregarding the potential distribution of an electrostatic latent image at the exposure spot.

The image density changes depending on the density and the line width (clearance ratio) of a scanning line toner image.

Moreover, the image forming apparatus 1 according to the above-described exemplary embodiment can secure reproducibility in size, line width, and image density, for a toner image developed from a beam spot, retroactively according to the basic potential distribution of an electrostatic latent image of a beam spot.

Sixth Exemplary Embodiment

Figure 12:
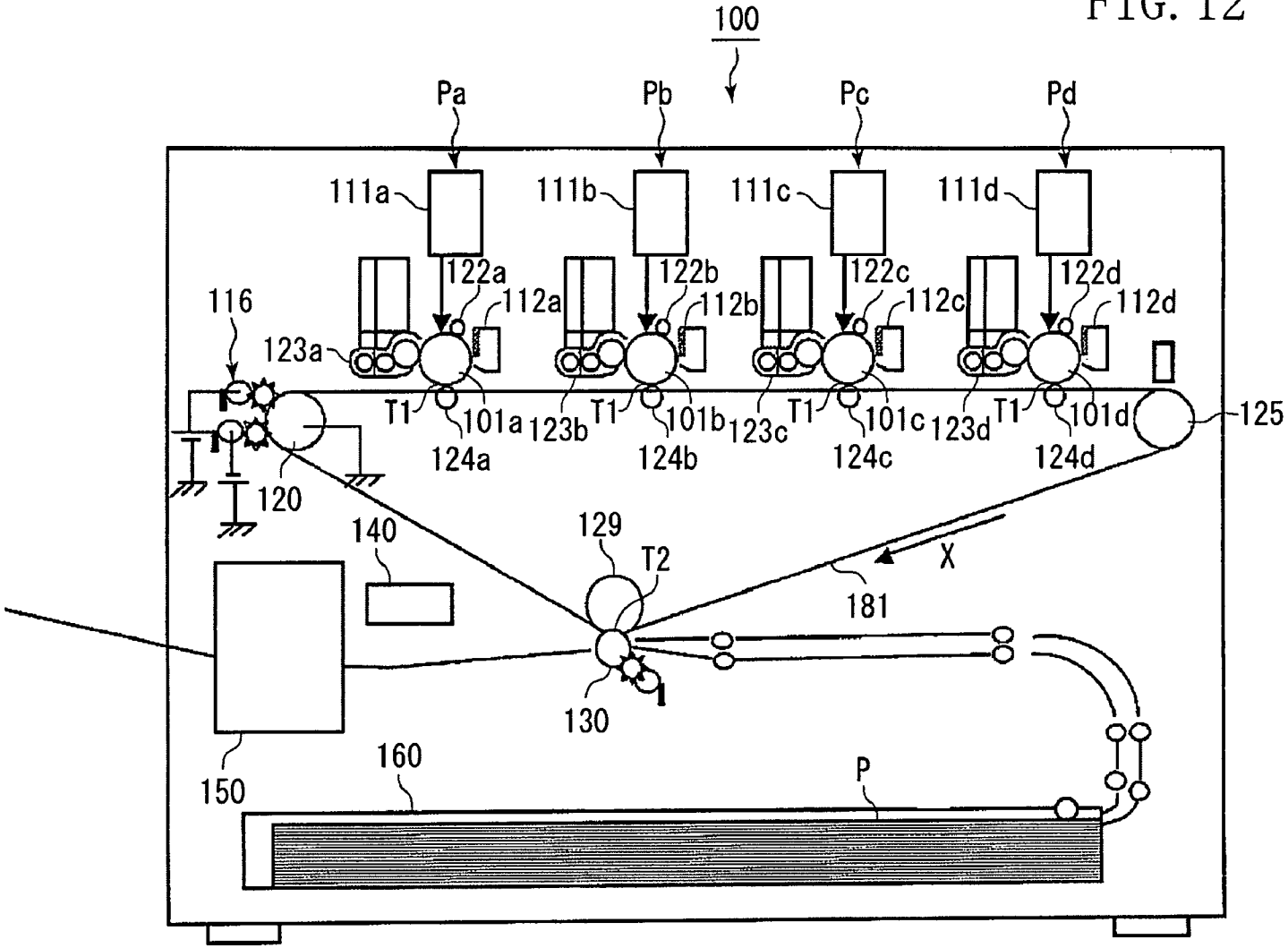
FIG. 12 illustrates an example of an image forming apparatus according to a sixth exemplary embodiment of the present invention.
Figure 13:
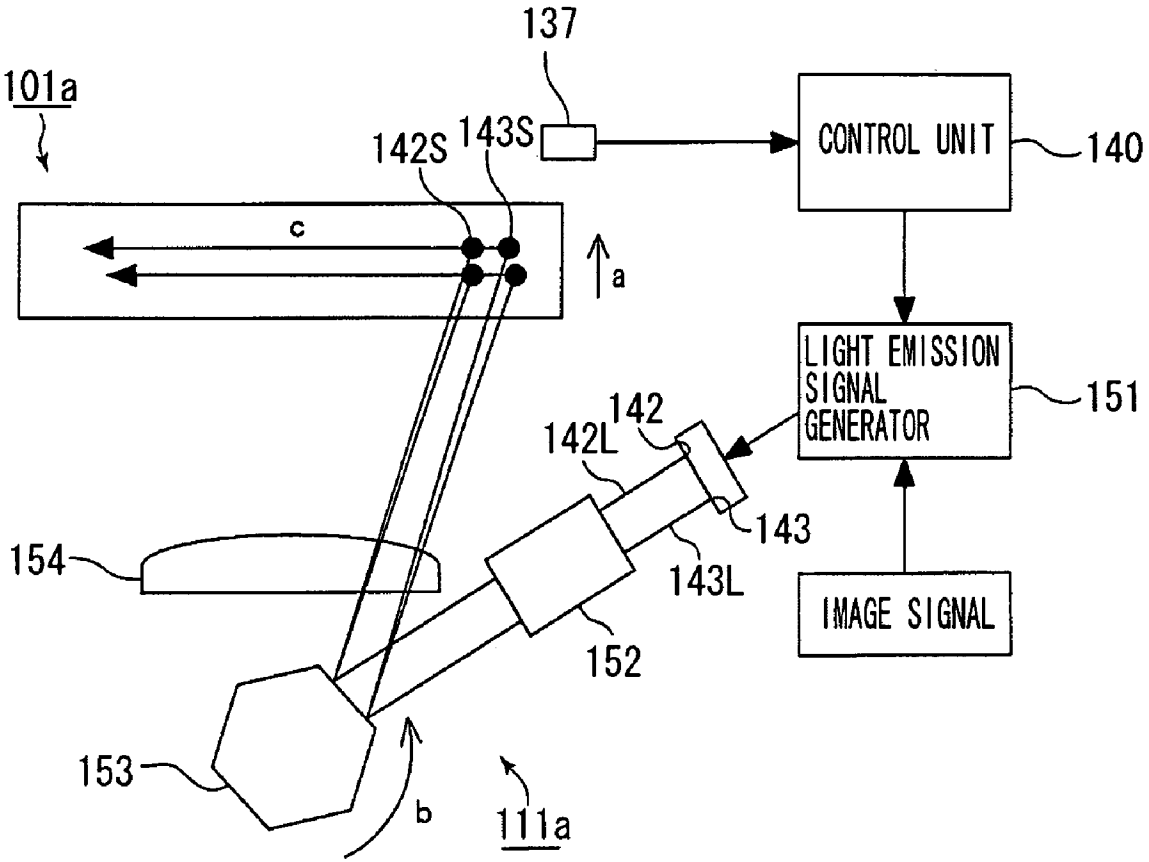
FIG. 13 illustrates an example of configuration of an exposure device.

FIG. 12 illustrates an example of an image forming apparatus according to a sixth exemplary embodiment of the present invention. FIG. 13 illustrates an example of an exposure device. An image forming apparatus 100 according to the sixth exemplary embodiment is a tandem copying machine operable according to an intermediate transfer method which includes yellow, magenta, cyan, and black image formation units Pa, Pb, Pc, and Pd disposed in a line along a straight part of an intermediate transfer belt 181.

As illustrated in FIG. 12, the image formation units Pa, Pb, Pc, and Pd are configured to form yellow, magenta, cyan, and black toner images on photosensitive drums 101*a*, 101*b*, 101*c*, and 101*d*, respectively. The image formation units Pa, Pb, Pc, and Pd have the same (or alternatively similar) configuration although associated developing devices 123*a*, 123*b*, 123*c*, and 123*d* are filled with different color of toners. Accordingly, this exemplary embodiment mainly describes the image formation unit Pa although the following description is applicable to other image formation units Pb, Pc, and Pd if the suffix "a" attached to "P" is replaced with "b", "c", or "d", and likewise with respect to the various reference numbers in FIG. 12 that end either with "b", "c", or "d".

The image formation unit Pa includes a primary charging device 122*a*, an exposure device 111*a*, a developing device 123*a*, a transfer device 124*a*, a cleaning device 112*a* which are disposed around the photosensitive drum 101*a* that can rotate in a predetermined direction.

The primary charging device 122*a* can uniformly charge a surface of photosensitive drum 101*a* prior to laser beam scanning exposure performed by the exposure device 111*a*. The primary charging device 122*a* includes a charging roller which receives a charging voltage from a high-voltage control unit (not illustrated).

The exposure device 111*a* can write an electrostatic latent image on the surface of photosensitive drum 101*a* by performing scanning of a laser beam modulated according to an image signal.

The developing device 123*a* develops the electrostatic latent image formed on the surface of photosensitive drum 101*a* with two-component developer carried on a developing sleeve (not illustrated). The developing sleeve rotates around a fixed magnetic sleeve while maintaining a small clearance between the sleeve body and the surface of photosensitive drum 101*a*. The developing sleeve, if a developing bias control circuit (not illustrated) applies a predetermined voltage (addition of the development voltage VDC and an alternating-current component), causes toner particles to move under an electrostatic force toward the electrostatic latent image on the photosensitive drum 101*a*.

The transfer device 124*a*, if a transfer voltage is applied from a transfer voltage control circuit (not illustrated), charges the intermediate transfer belt 181 when the belt 181 passes a transfer unit T1 and causes the toner image to transfer from the photosensitive drum 101*a* to the intermediate transfer belt 181. The cleaning device 112*a* includes blades contacting the surface of photosensitive drum 101*a* to remove any toner particles remaining on the drum 101*a* without being transferred onto the intermediate transfer belt 181, as preparation for the next toner image formation.

The intermediate transfer belt 181 is mounted on a drive roller 125, a driven roller 120, and a secondary transfer inner roller 129, and rotates in a direction indicated by the arrow "X". A secondary transfer outer roller 130 is pressed against the secondary transfer inner roller 129 via the intermediate transfer belt 181 so as to form a secondary transfer unit T2.

The toner images of respective colors are formed on the photosensitive drums 101*a*, 101*b*, 101*c*, and 101*d* at different timing and are primarily transferred on the same position of the intermediate transfer belt 181. Then, one recording material P is fed from a sheet cassette 160 in synchronism with formation of a 4-color toner image on the intermediate transfer belt 181, so that both the 4-color toner image and the recording material P can pass the secondary transfer unit T2 at the same timing. If a secondary transfer power source (not illustrated) applies a transfer voltage having the polarity opposed to that of the toner image to a secondary transfer outer roller 140, the entire 4-color toner image is secondarily transferred from the intermediate transfer belt 181 to the recording material P.

The recording material P is conveyed into a fixing device 150 in which the 4-color toner image secondarily transferred on the recording material P is subjected to a heating/pressing treatment to fix a toner image on the surface of the recording material P. The recording material P on which the full-color image is fixed is discharged from the machine body to a discharge tray. If any toner particles remain on the intermediate transfer belt 181 after the belt 181 has passed through the secondary transfer unit T2, a belt cleaning device 116 removes the remaining toner particles from the intermediate transfer belt 181.

A control unit (central processing unit (CPU)) 140 controls the image formation units Pa, Pb, Pc, and Pd and the intermediate transfer belt 181 to perform the above-described image formation processing.

Referring now also to FIG. 13, the control unit 140 receives a detection signal representing the absolute humidity from a temperature/humidity sensor 137 and controls a light emission signal generator 151 based on the detected absolute humidity value. The light emission signal generator 151 determines a destination of light emission signal between two semiconductor lasers 142 and 143 having different oscillation wavelengths based on a command supplied from the control unit 140.

The semiconductor lasers 142 and 143 emit laser beams 142L and 143L that reach the surface of photosensitive drum 101*a* via a collimator lens 152, an optical deflector 153, and an imaging optical unit 154 and form exposure spots 142S and 143S on the surface of photosensitive drum 101*a*.

The light emission signal generator 151 sets a delay time corresponding to a distance between two exposure spots 142S and 143S and drives the semiconductor lasers 142 and 143 according to the same image signal. According to this arrangement, pixels disposed along a scanning line formed on the photosensitive drum 101*a* are subjected to the double exposure of two laser beams 142L and 143L. The exposure spots 142S and 143S perform writing of the same image information.

The collimator lens 152 converts the laser beams 142L and 143L emitted from the semiconductor lasers 142 and 143 into a parallel luminous flux.

The optical deflector 153 is, for example, a rotary polygonal mirror that includes a plurality of deflection surfaces (reflection surfaces) and rotates in a direction indicated by the arrow "b" at a predetermined speed when driven by a motor (not illustrated).

The imaging optical unit 154 is an image-forming unit including three lenses (not illustrated) which are combined in a predetermined positional relationship to realize required f-θ characteristics. The imaging optical unit 154 receives the laser beam based on image information reflected by the optical deflector 153 to form an image on the surface of photosensitive drum 101*a*.

The photosensitive drum 101*a* (scanned surface) rotates in a sub scanning direction "a" at a predetermined speed, if driven by a motor (not illustrated), and writes image information (forms an electrostatic latent image) on a surface photosensitive layer of photosensitive drum 101*a*.

In the exposure device 111*a*, two semiconductor lasers 142 and 143 are disposed two-dimensionally and spaced from each other in the main scanning direction. The semiconductor lasers 142 and 143 are two surface-emitting laser elements formed on a common semiconductor substrate and separated from each other along an element separation groove. The semiconductor lasers 142 and 143 can be independently driven. The semiconductor laser 142 has an oscillation wavelength of 780 nm. The semiconductor laser 143, made of a GaN material, has an oscillation wavelength of 440 nm. The semiconductor lasers 142 and 143 arrayed in the main scanning direction can be used to perform multiple-exposure processing on the photosensitive drum 101*a*, change an effective exposure spot size, and express the gradation.

The control unit 140 can change an output ratio of the semiconductor laser 142 to the semiconductor laser 143 to change the potential profile of an electrostatic latent image, and reproduce a toner image having a constant line width as a result of development.

Figure 14:
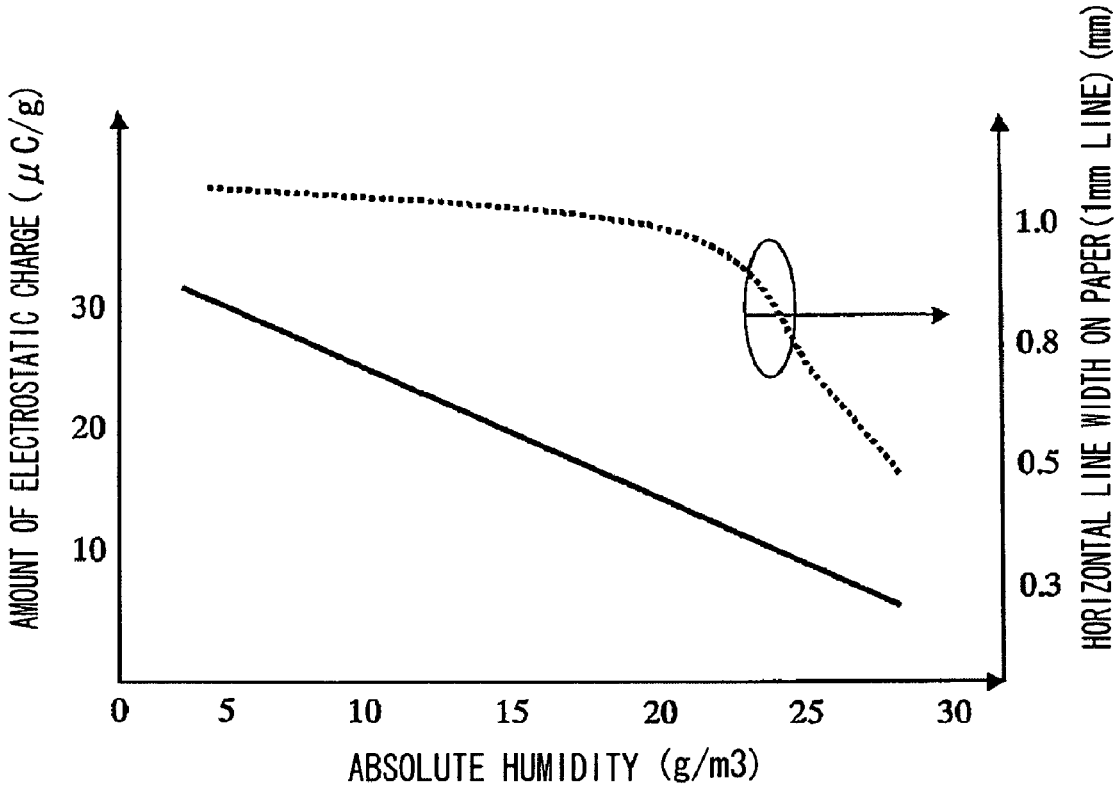
FIG. 14 is a graph illustrating an example of a relationship between humidity in the air and developed line width.
Figure 15:
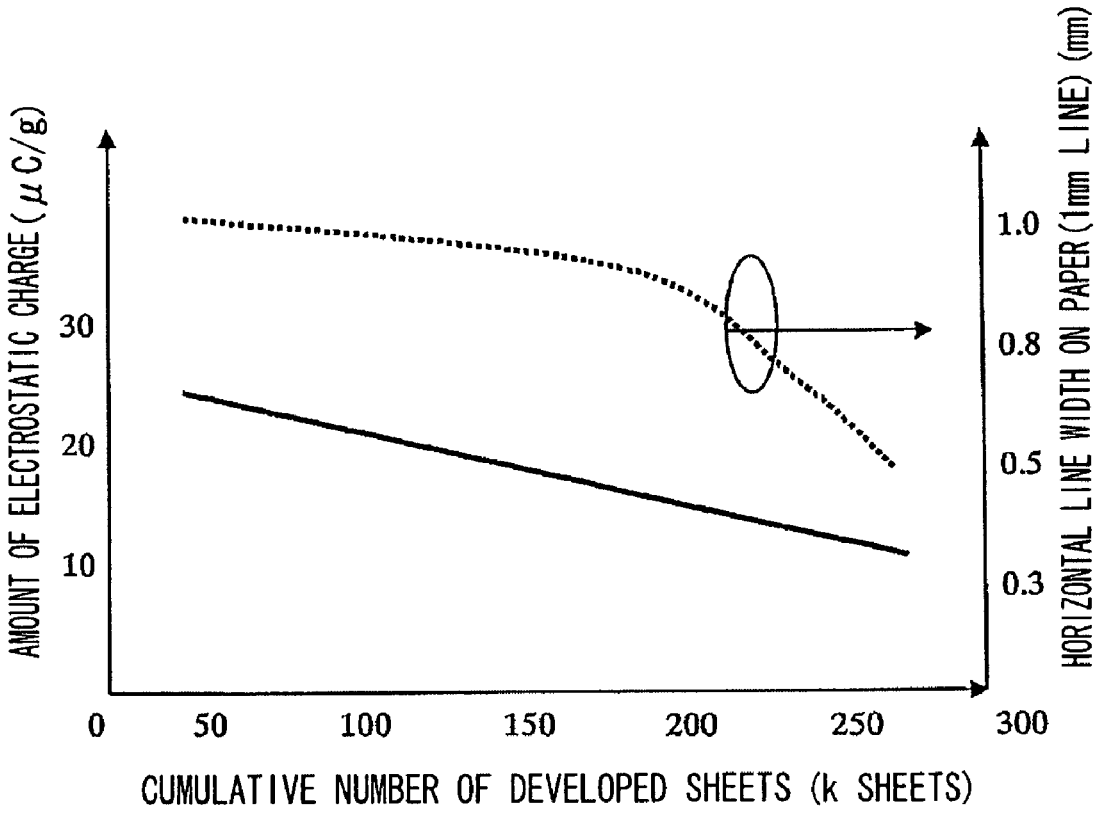
FIG. 15 is a graph illustrating an example of a relationship between cumulative number of development operations performed by a developing device and developed line width.
Figure 16:
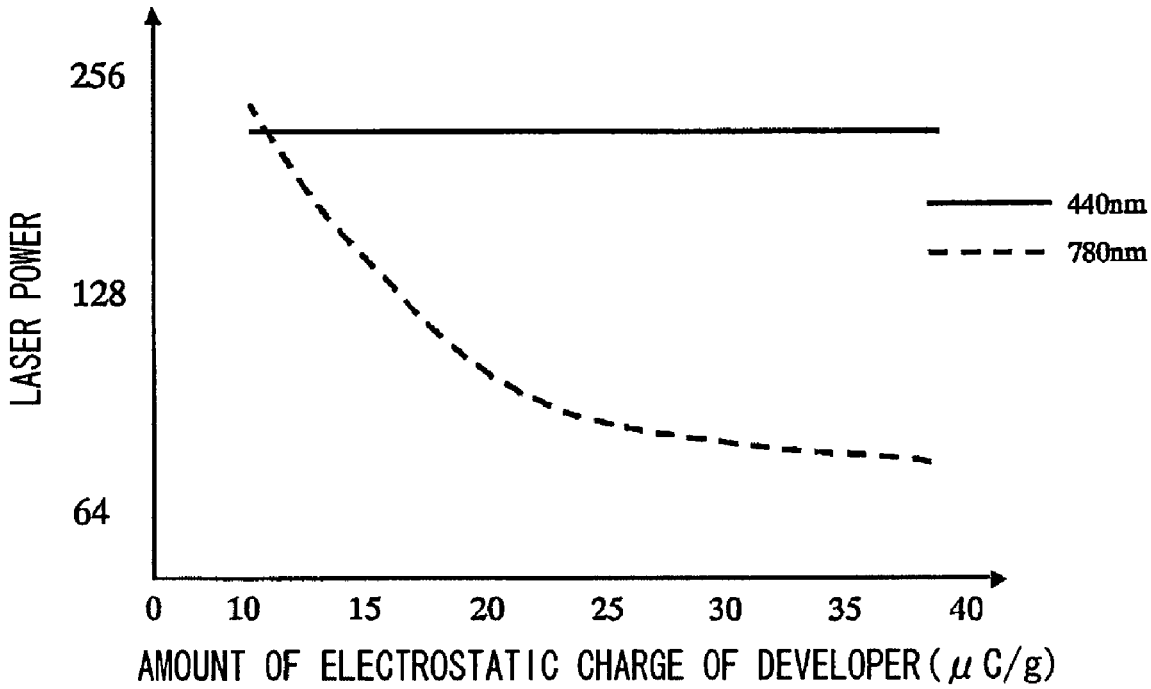
FIG. 16 is a graph illustrating an example of output rate control for two semiconductor lasers having different oscillation wavelengths.
Figure 17A:
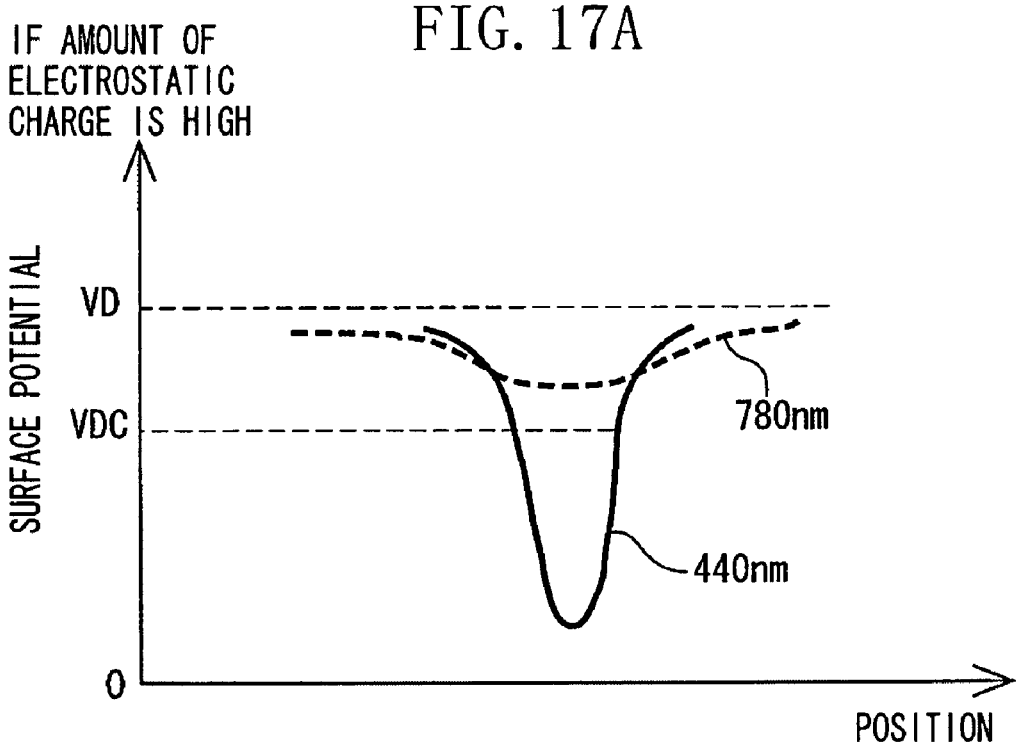
FIGS. 17A and 17B illustrate examples of relationships between output rates of two semiconductor lasers having different oscillation wavelengths and potential distribution of an electrostatic latent image.
Figure 17B:
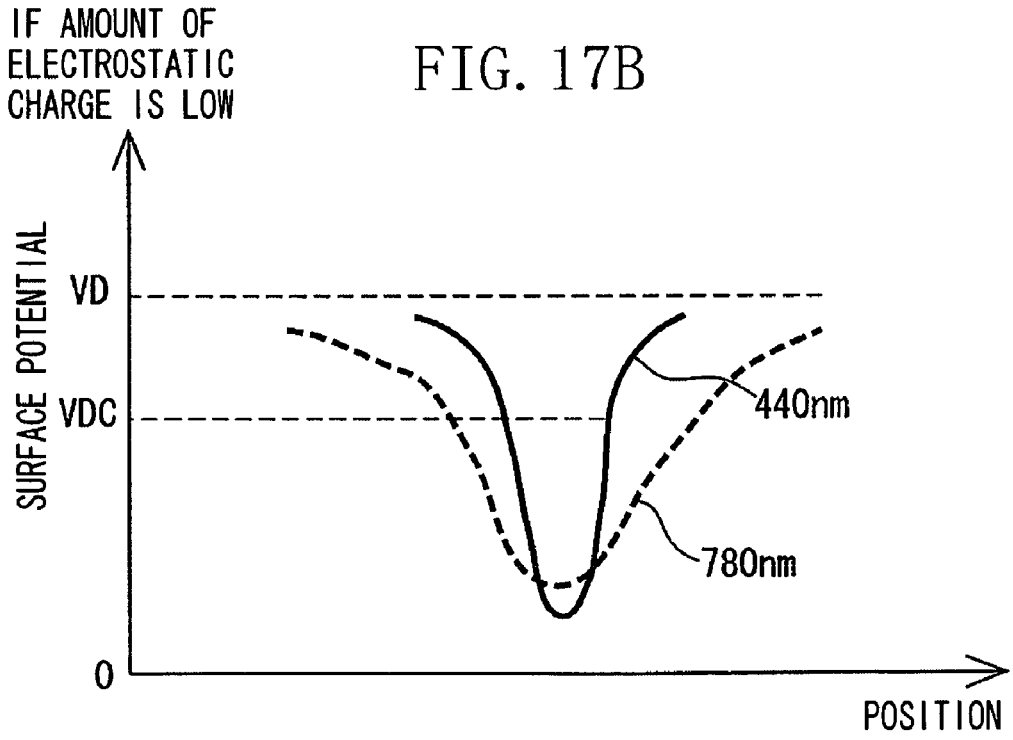

FIG. 14 is a graph illustrating an example of a relationship between the humidity in the air and a developed line width. FIG. 15 is a graph illustrating an example of a relationship between the cumulative number of development operations performed by a developing device and a developed line width. FIG. 16 is a graph illustrating an example output rate control for two semiconductor lasers having different oscillation wavelengths. FIGS. 17A and 17B illustrate examples of relationships between output rates of two semiconductor lasers having different oscillation wavelengths and the potential distribution of an electrostatic latent image.

In the sixth exemplary embodiment, in a state where the lasers 142 and 143 form exposure spots on the same position, the control unit 140 gradually decreases the exposure rate for the semiconductor laser 143 according to an increase in the cumulative development amount of the developing device 123*a*.

The control unit 140 decreases the exposure rate for the semiconductor laser 143 if the cumulative operation time of the developing device 123*a* reaches a predetermined value.

The control unit 140 decreases the exposure rate for the semiconductor laser 143 at an exposed portion subjected to multiple-exposure processing if the ambient humidity of the photosensitive drum 101*a* is higher than a predetermined value.

In the sixth exemplary embodiment, if the cumulative development amount (number of developed sheets) of the developing device 123*a* increases, the control unit 140 decreases the exposure ratio of laser beam 143L relative to the total exposure amount at an exposure point. Furthermore, if the cumulative operation time (cumulative number of operations) of the developing device 123*a* exceeds a predetermined limit value, the control unit 140 decreases the exposure ratio of laser beam 143L relative to the total exposure amount.

Furthermore, if the ambient humidity of the photosensitive drum 101*a* increases, the control unit 140 decreases the exposure ratio of laser beam 143L relative to the total exposure amount at the exposure point. Furthermore, if the ambient humidity exceeds a predetermined limit value, the control unit 140 decreases the exposure ratio of laser beam 143L relative to the total exposure amount.

In the electrophotographic process, even if laser exposure conditions of an exposure device are optimized for a high quality image, maintaining the image quality is difficult if any change occurs in conditions for other image formation processing. Among conditional changes of other image formation processing, usage environmental conditions and endurance conditions have significant effects on a developer.

For example, if the image formation is repetitively performed in a highly-humid environment, the amount of electrostatic charge carried by toner particles in a developer decreases and it becomes difficult to accurately reproduce an electrostatic latent image with a laser. The formation of an image with thin and high-density lines requires development of a toner image with toner particles sufficiently supplied to the periphery of an electrostatic latent image of a line.

However, in conventional apparatuses, if a developer is in a deteriorated state, then it cannot sufficiently distribute toner particles to the periphery of a line (electrostatic latent image having an ordinary potential distribution). The developed line becomes a thin line. In particular, such defectiveness occurs in the development of a line extending the main scanning direction of a laser beam.

Hence, the sixth exemplary embodiment determines whether the developer is in a deteriorated state and updates laser exposure conditions based on an image reproduction rate obtainable from a determined result. Thus, the sixth exemplary embodiment can form an electrostatic latent image taking account of deterioration in a developer so that the layer of toner particles has a required thickness. Accordingly, this exemplary embodiment can form a high-quality image regardless of deterioration in the developer.

As illustrated in FIG. 13, the temperature/humidity sensor 137 is configured to detect usage environmental conditions and is disposed in the vicinity of the developing device 123*a* for the photosensitive drum 101*a*. The temperature/humidity sensor 137 (e.g., model ES2-THB® of OMRON®) can detect the temperature and the humidity in a usage environment of the image forming apparatus 100. The control unit 140 estimates usage environmental conditions of the developing device 123*a* based on a detection result obtained from the temperature/humidity sensor 137.

The control unit 140 includes a counter that can count the number of developed images for each of the developing devices 123*a*, 123*b*, 123*c*, and 123*d*. The counted number of developed images can be used to estimate the developer state in each of the developing devices 123*a*, 123*b*, 123*c*, and 123*d*.

The control unit 140 controls the semiconductor lasers 142 and 143 having mutually different oscillation wavelengths based on a detection result obtained by the temperature/humidity sensor 137 and the recorded number of developed images so that the exposure spots 142S and 143S are formed on the same exposure point when the semiconductor lasers 142 and 143 perform multiple-exposure processing.

The control unit 140 changes the size of each exposure spot 142S or 143S by changing the output rates of the semiconductor lasers 142 and 143. Thus, the control unit 140 changes the point size and the line thickness of an electrostatic latent image formed on the photosensitive drum 101*a*.

FIG. 14 illustrates an example of a relationship between the amount of electrostatic charge (μC/g) carried by toner particles relative to the humidity in the air (g/m$^3$) calculated from an output value of the temperature/humidity sensor 137. Additionally illustrated on FIG. 14 is the line width of 1 mm line image formed on a plain paper. A general microscope can be used for measurement of the line width.

As illustrated in FIG. 14, the amount of electrostatic charge carried by toner particles has a negative correlation with the humidity in the air and gradually decreases according to an increase in the humidity in the air. In the range of 1 to 20 g/m$^3$ in the humidity, the line width of a printed line image can maintain reproduction rate α substantially equal to 100% regardless of reduction in the amount of electrostatic charge. However, the line width reproduction rate α starts decreasing if the humidity exceeds 20 g/m$^3$, i.e., in a highly-humid environment. The line width at the humidity of 27 g/m$^3$ decreases to 0.5 mm. The line width reproduction rate α goes down to 50%.

FIG. 15 illustrates an example of a relationship between the cumulative number of development operations performed by the developing device 123*a* and the amount of electrostatic charge (μC/g) carried by toner particles. Additionally illustrated on FIG. 15 is the line width of 1 mm line image formed on a plain paper. A general microscope can be used for measurement of the line width. Measurement of the cumulative number of developing operations includes forming an endurance chart image having a 10% image occupation ratio relative to the area of a recording material (plain paper). The humidity in the air of the experimental environmental conditions is fixed to 8 g/m$^3$.

As illustrated in FIG. 15, the amount of electrostatic charge carried by toner particles has a negative correlation with the cumulative number of images developed by the developing device 123*a* and gradually decreases according to an increase in the cumulative number of developed sheets. In the range of 0 to 200 k sheets in the cumulative number of developing operations, the line width of a printed line image can maintain reproduction rate α substantially equal to 100% regardless of reduction in the amount of electrostatic charge. However, the line width reproduction rate α starts decreasing if the cumulative developed sheets exceeds 200 k sheets, which in this example is the late stage of the life cycle. The line width in the late stage of the life cycle exceeding 270 k sheets decreases to 0.5 mm. The line width reproduction rate α goes down to 50%.

As apparent from the foregoing description, the line width reproduction rate α is dependent on usage environmental conditions (humidity in the air) of the image forming apparatus and the cumulative number of developing operations. Table 5 illustrates example values of the line reproduction rate α in relation to the above-mentioned two parameters.

TABLE 5

DETECTION VALUES OF EACH PARAMETER AND LINE REPRODUCTION RATE (a)

| | | HUMIDITY (g/m^3) | | | | |
|---|---|---|---|---|---|---|
| | | 5 | 15 | 20 | 25 | 30 |
| NUMBER OF | 50 | 1.00 | 0.95 | 0.80 | 0.75 | 0.50 |
| SHEETS | 100 | 0.05 | 0.90 | 0.76 | 0.71 | 0.48 |
| ENDURED | 150 | 0.80 | 0.76 | 0.64 | 0.60 | 0.40 |
| (×1000 | 200 | 0.75 | 0.71 | 0.60 | 0.56 | 0.38 |
| SHEETS) | 250 | 0.50 | 0.48 | 0.40 | 0.38 | 0.25 |

※VALUE OF a: 1 REPRESENTS 100% REPRODUCIBILITY

As described above, the image forming apparatus 100 according to the sixth exemplary embodiment is under the influence of two parameters with respect to the line width reproduction rate α. Namely, two parameters have effects on the amount of electrostatic charge of a developer. The amount of electrostatic charge of the developer changes the line reproduction rate α. To stabilize the line width against any change in usage environmental conditions or an increase in the cumulative number of developing operations, the image forming apparatus 100 according to this exemplary embodiment increases the line width of an electrostatic latent image (latent image width) in proportion to a reciprocal of the line width reproduction rate α. Thus, the image forming apparatus 100 according to this exemplary embodiment can constantly equalize the line width reproduction rate α to 100%.

In this case, if the line width reproduction rate α is calculated from a conversion table based on usage environmental conditions, the number of pixels corresponding to the line width of image data can be obtained with reference to the calculated line width reproduction rate α. The line width of an electrostatic latent image can be increased when an image is formed. However, variously modifying or changing the image data leads to a complicated configuration of the image processing system and may not be preferable for the image forming apparatus 100 that is configured to obtain a high-speed/high-quality image. The modifications or changes on the image data may damage details of an image.

Hence, the sixth exemplary embodiment enlarges the substantial line width of an electrostatic latent image without changing the image data configuration for an electrostatic latent image formed on the photosensitive drum 101*a*. The sixth exemplary embodiment adjusts the output ratio of a long-wavelength laser source having a large exposure spot size to a short-wavelength laser source having a small exposure spot size and forms an electrostatic latent image having an optimum line width considering the line width reproduction rate α. More specifically, as illustrated in FIG. 13, the control unit 140 adjusts the output ratio of the semiconductor laser 142 having the oscillation wavelength of 780 nm to the semiconductor laser 143 having the oscillation wavelength of 440 nm based on Table 6.

TABLE 6

TABLE FOR CONVERTING DETECTION VALUE OF EACH PARAMETER INTO LONG-WAVELENGHT LASER POWER

| | | HUMIDITY (g/m^3) | | | | |
|---|---|---|---|---|---|---|
| | | 5 | 15 | 20 | 25 | 30 |
| NUMBER OF | 50 | 63 | 66 | 78 | 83 | 125 |
| SHEETS | 100 | 66 | 69 | 82 | 88 | 132 |
| ENDURED | 150 | 78 | 82 | 98 | 104 | 156 |
| (×1000 | 200 | 83 | 88 | 104 | 111 | 167 |
| SHEETS) | 250 | 125 | 132 | 156 | 187 | 250 |

※255 REPRESENT MAXIMUM OUTPUT OF LASER POWER

Table 6 illustrates output values of the long-wavelength laser power corresponding to various combinations of the temperature/humidity and the number of images developed by a developing device (number of sheets endured). The laser power can be controlled in the gradation range of 0 to 256, in which the gradation level 256 corresponds to the maximum light emission power.

FIG. 16 illustrates an example of a relationship between a developer and output rates of two semiconductor lasers according to the sixth exemplary embodiment. The semiconductor laser 143 having the oscillation wavelength of 440 nm is configured to generate a constant output. The semiconductor laser 142 having the oscillation wavelength of 780 nm is configured to increase its output level according to reduction in the amount of electrostatic charge carried by toner particles. Thus, if the amount of electrostatic charge carried by toner particles is reduced, an electrostatic latent image is thickened. Thus, even if the adhesion of toner particles is insufficient, this exemplary embodiment can control the thickness of a toner image so that the line reproduction rate $\alpha$ can reach 100%.

FIGS. 17A and 17B illustrate general ideas of electrostatic latent images formed on the photosensitive drum 101*a* realized by changing the output rate between two semiconductor lasers. Enhancing the long-wavelength laser power having a wide spot diameter enables forming an electrostatic latent image having a line width wider than that of the original electrostatic latent image and compensates the reduction in reproduction rate $\alpha$ of a developed line if the amount of electrostatic charge is decreased.

In the above-described state, an endurance test for 300 k sheets has been carried out. Usage environmental conditions for the endurance test are set to realize a high-temperature/high-humid environment. More specifically, the temperature is set to 30° C. and the humidity is set to 80%. The recording material used in this test is a plain paper of A3 size. An image used in this test is an endurance chart image having an image occupation rate of 10% relative to the entire area of a paper. The endurance test for 300 k sheets has demonstrated that a line image can be stably maintained and the correlation between the conversion table and an actual line image can be adequately maintained.

The sixth exemplary embodiment realizes multiple-exposure processing using two laser beams 142L and 143L to form a combined exposure spot at the same exposure point by changing light quantities of laser beams 142L and 143L based on usage environmental conditions obtained from the temperature/humidity sensor 137. Thus, the sixth exemplary embodiment can perform an optimum setting for an electrostatic latent image according to usage conditions of the image forming apparatus 100. In particular, the sixth exemplary embodiment can set an optimized electrostatic latent image for the line width.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-128638 filed May 14, 2007, which is hereby incorporated by reference herein in its entirety.

What is claimed is:

1. An image forming apparatus, comprising:

an image carrier;

a charging device configured to charge the surface of the image carrier;

an exposure device, including a first exposure unit configured to emit a first laser and a second exposure unit configured to emit a second laser so as to form an electrostatic latent image on the image carrier, the first laser and the second laser configured to expose a same exposure spot, wherein a spot size of the second laser is larger than a spot size of the first laser when the first exposure unit and the second exposure unit emit the first laser and the second laser, respectively, with a same light amount;

an image formation unit configured to develop an electrostatic latent image formed by the exposure device into a toner image; and an exposure control unit configured to control the first exposure unit or the second exposure unit so as to change an exposure ratio between an exposure amount of the first laser and an exposure amount of the second laser for exposing the same exposure spot with the first laser and the second laser, wherein the exposure control unit is configured to change the exposure ratio between a first exposure ratio and a second exposure ratio different from the first exposure ratio when the first exposure unit or the second exposure unit exposes the image carrier on the basis of image data for forming an image with a certain density.

2. The image forming apparatus according to claim 1, the exposure control unit controls the first exposure unit so as to increase the exposure rate of the first laser in the exposure ratio, in a case of increasing an exposure amount of an exposure spot to be exposed with the first laser and the second laser.

3. The image forming apparatus according to claim 1, wherein if required to increase a charging potential on the surface of the image carrier by the charging device according to a cumulative number of image formations or a cumulative exposure time, the exposure control unit decreases an exposure rate of the first laser at the exposure portion where the exposure spots of the first laser and the second laser are placed one upon another.

4. The image forming apparatus according to claim 1, wherein the first laser has a wavelength shorter than a wavelength of the second laser.

5. The image forming apparatus according to claim 4, wherein the image carrier has a spectral sensitivity level which is lower at the wavelength of the second laser than at the wavelength of the first laser.

6. The image forming apparatus according to claim 1, wherein the exposure control unit decreases an exposure rate of the first laser at the exposed portion where the exposure spots of the first laser and the second laser are placed one upon another according to an increase in a cumulative amount of developments performed by the image formation unit.

7. The image forming apparatus according to claim 1, wherein in a case in which a cumulative time of operations performed by the image formation unit has reached a predetermined value, the exposure control unit decreases an exposure rate of the first laser at the exposed portion where the exposure spots of the first laser and the second laser are placed one upon another.

8. The image forming apparatus according to claim 1, wherein the exposure control unit is operable to change the exposure ratio of the first laser to the second laser according to any change in environmental conditions.

9. The image forming apparatus according to claim 8, wherein in a case in which the ambient humidity of the image carrier is higher than a predetermined value, the exposure control unit decreases an exposure rate of the first laser at the exposed portion where the exposure spots of the first laser and the second laser are placed one upon another.

* * * * *